US011112735B2

(12) United States Patent
Minobe et al.

(10) Patent No.: US 11,112,735 B2
(45) Date of Patent: Sep. 7, 2021

(54) IMAGE FORMING APPARATUS

(71) Applicant: CANON KABUSHIKI KAISHA, Tokyo (JP)

(72) Inventors: Taro Minobe, Ichikawa (JP); Keizo Kojima, Yokohama (JP); Naoki Kanno, Fujisawa (JP); Atsushi Nakamoto, Tokyo (JP); Toshihiko Takayama, Kawasaki (JP); Hideo Nanataki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/714,533

(22) Filed: Dec. 13, 2019

(65) Prior Publication Data

US 2020/0201212 A1 Jun. 25, 2020

(30) Foreign Application Priority Data

Dec. 25, 2018 (JP) ..... JP2018-241795
Dec. 25, 2018 (JP) ..... JP2018-241803

(51) Int. Cl.
*G03G 15/16* (2006.01)

(52) U.S. Cl.
CPC ..... *G03G 15/1665* (2013.01)

(58) Field of Classification Search
CPC ..... G03G 15/1665
USPC ..... 399/66
See application file for complete search history.

(56) References Cited

U.S. PATENT DOCUMENTS

2009/0080923 A1* 3/2009 Murayama ..... G03G 15/1675 399/66
2014/0369706 A1* 12/2014 Shimizu ..... G03G 15/0136 399/66

FOREIGN PATENT DOCUMENTS

| | | | |
|---|---|---|---|
| JP | 2001083758 A | | 3/2001 |
| JP | 2014115484 A | | 6/2014 |
| JP | 2015011261 A | * | 1/2015 |
| JP | 2015011261 A | | 1/2015 |
| JP | 2016109745 A | | 6/2016 |

OTHER PUBLICATIONS

Ogawara. Translations of JP-2015011261-A. Published Jan. 2015. Translated Oct. 2020. (Year: 2015).*

* cited by examiner

*Primary Examiner* — Walter L Lindsay, Jr.
*Assistant Examiner* — Philipmarcus T Fadul
(74) *Attorney, Agent, or Firm* — Canon U.S.A., Inc, IP Division

(57) ABSTRACT

A controller can select and execute a full color mode of performing image formation in a first state in which each primary transfer member is in contact with an intermediate transfer belt, and a monochrome mode of performing image formation in a second state in which only a primary transfer member is in contact with the intermediate transfer belt. The controller determines which state of the first state and the second state is formed, based on a detection result obtained by a current detection circuit when a photosensitive drum is charged by a charging roller, and voltage is applied to the primary transfer member from a primary transfer power source.

22 Claims, 23 Drawing Sheets

IMAGE FORMING APPARATUS

BACKGROUND OF THE DISCLOSURE

Field of the Disclosure

The present disclosure relates to an image forming apparatus that forms an image by sequentially transferring toner images with a plurality of colors onto a transfer material using an electrophotographic system.

Description of the Related Art

In a conventionally known configuration of electrophotographic color image forming apparatuses, toner images are sequentially transferred from image forming units of the respective colors onto an intermediate transfer member, such as an intermediate transfer belt, and the sequentially transferred toner images are collectively transferred from the intermediate transfer member onto a transfer material.

In such image forming apparatuses, each of the image forming units of the respective colors includes a drum-shaped photosensitive member (hereinafter, will be referred to as a photosensitive drum) serving as an image bearing member. The toner image formed on the photosensitive drum of each image forming unit is primarily transferred onto the intermediate transfer member at a primary transfer portion at which the photosensitive drum and the intermediate transfer member are in contact with each other, by applying voltage from a transfer power source to a primary transfer member which is disposed to face the photosensitive drum via the intermediate transfer member. The toner images with the respective colors that have been primarily transferred onto the intermediate transfer member from the image forming units of the respective colors are secondarily transferred collectively from the intermediate transfer member onto a transfer material, such as paper or an overhead projector (OHP) sheet, by application of voltage from a secondary transfer power source to a secondary transfer member at a secondary transfer portion. After that, the toner images with the respective colors that have been transferred onto the transfer material are fixed onto the transfer material by a fixing unit.

In recent years, some image forming apparatuses have a configuration of stopping operations of image forming units other than an image forming unit storing black toner when an image that only uses black toner (hereinafter, will be referred to as a monochrome image) is formed. More specifically, the operations of image forming units not used for image formation of a monochrome image are stopped. In this configuration, primary transfer members corresponding to the image forming units not to be used for image formation of a monochrome image is separated from an intermediate transfer member, and operations of the separated image forming units are stopped, whereby abrasion and deterioration of members in the image forming units not to be used for image formation can be prevented.

Japanese Patent Application Laid-Open No. 2001-83758 discusses a configuration in which one transfer power source and one current detection circuit are disposed for each of primary transfer members corresponding to the respective image forming units, and a contact state between each primary transfer member and an intermediate transfer member is determined based on a comparison between detection results of current flowing from a predetermined primary transfer member to a photosensitive drum.

The current flowing from a primary transfer member to a photosensitive drum varies depending on a potential difference between the primary transfer member and the photosensitive drum, or a change in resistance value of each member, such as an intermediate transfer member or a primary transfer member. If a variation amount of current flowing from the primary transfer member to the photosensitive drum is large, accurate detection of a contact state between the intermediate transfer member and the primary transfer member may become difficult. Particularly in the configuration of applying voltage from a common transfer power source to a plurality of primary transfer members, since the above-described potential difference and the change in resistance value are obtained for each of a plurality of image forming units, a variation amount of current flowing from the primary transfer member to the photosensitive drum tends to be large.

SUMMARY OF THE DISCLOSURE

The present disclosure is directed to accurately determining a contact state between an image bearing member and an intermediate transfer member based on a current flowing in a primary transfer member, in an image forming apparatus that applies voltage from a transfer power source to a plurality of primary transfer members.

According to an aspect of the present disclosure, an image forming apparatus is provided that includes a first image bearing member configured to bear a toner image, a first charging member configured to charge the first image bearing member, a second image bearing member configured to bear a toner image with a color different from the first image bearing member, an intermediate transfer member onto which a toner image borne by at least one of the first image bearing member or the second image bearing member is transferred, a first transfer member that is disposed at a position corresponding to the first image bearing member via the intermediate transfer member, and is configured to transfer a toner image onto the intermediate transfer member from the first image bearing member, a second transfer member that is provided at a position corresponding to the second image bearing member via the intermediate transfer member, and is configured to transfer a toner image onto the intermediate transfer member from the second image bearing member, a transfer power source configured to apply voltage to the first transfer member and the second transfer member, a detection unit configured to detect currents flowing in the first transfer member and the second transfer member, in a case where voltage is applied to the first transfer member and the second transfer member from the transfer power source, and a control unit configured to select and execute either a mode of transferring a toner image onto the intermediate transfer member from at least one of the first image bearing member or the second image bearing member in a first state in which the first transfer member and the second transfer member are in contact with the intermediate transfer member, or a mode of transferring a toner image onto the intermediate transfer member from the first image bearing member in a second state in which the first transfer member is in contact with the intermediate transfer member and the second transfer member is separated from the intermediate transfer member. The control unit determines which state of the first state and the second state is formed, based on a detection result obtained by the detection unit when the first image bearing member is charged by the first charging member, and voltage is applied to the first transfer member and the second transfer member from the transfer power source.

Further features and aspects of the present disclosure will become apparent from the following description of example embodiments with reference to the attached drawings.

DESCRIPTION OF THE EMBODIMENTS

Hereinafter, numerous example embodiments, features and aspects of the disclosure will be described in detail with reference to the drawings. In the following example embodiments, dimensions, materials, shapes, and relative arrangements of components to be described below are to be appropriately changed in accordance with various conditions and the configuration of an apparatus to which the disclosure is applied, and are not intended to limit the present disclosure to the following example embodiments.

[Example Configuration and Operation of Image Forming Apparatus]

Figure 1:
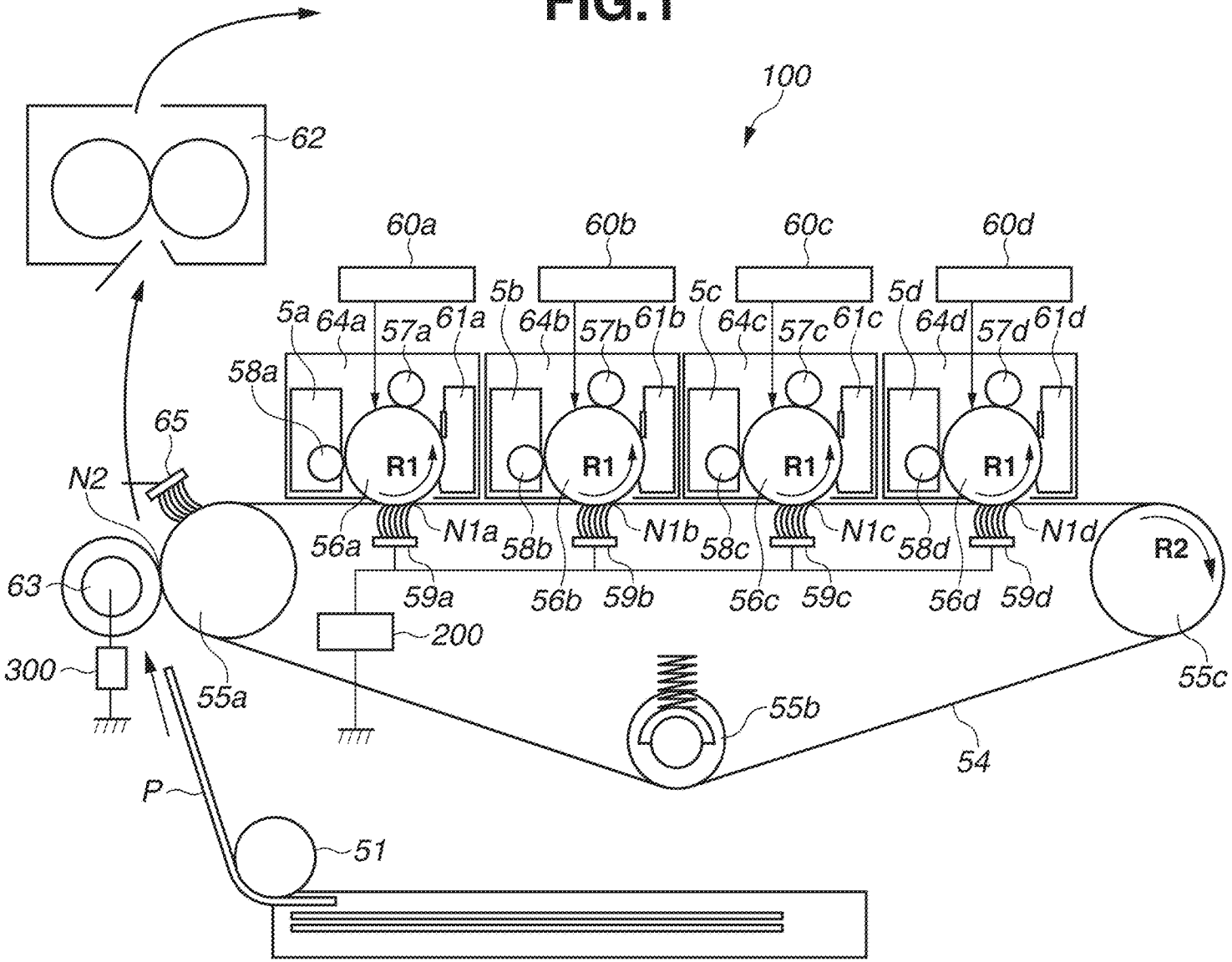
FIG. 1 is a schematic diagram illustrating a configuration of an example image forming apparatus according to a first example embodiment.
Figure 2:
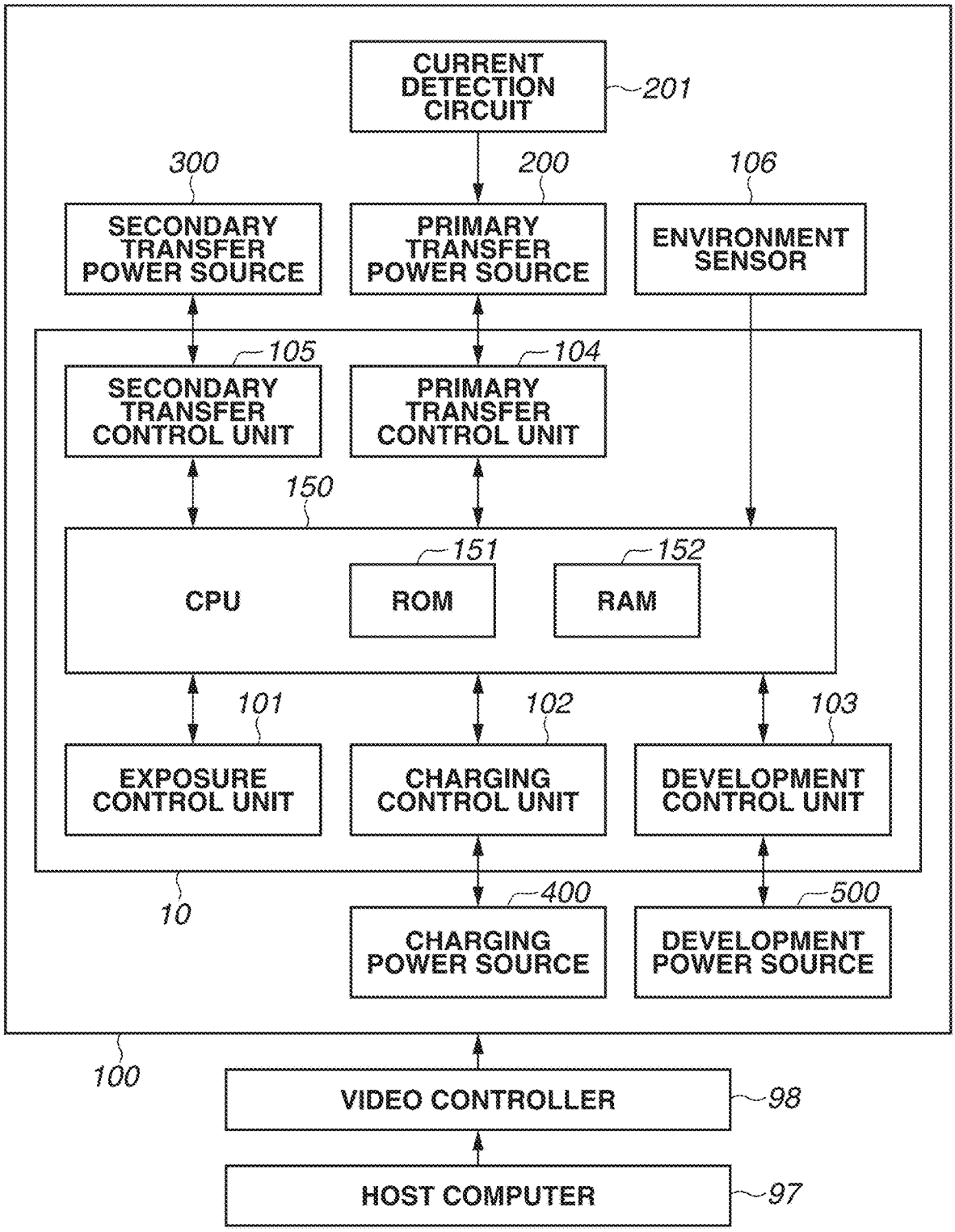
FIG. 2 is a block diagram illustrating control related to image formation according to the first example embodiment.

FIG. 1 is a schematic cross-sectional diagram of an image forming apparatus 100 according to the present example embodiment. FIG. 2 is a block diagram of a control system of the image forming apparatus 100 according to the present example embodiment. As illustrated in FIG. 2, the image forming apparatus 100 is connected to a host computer 97 which is an external device. An operation start command and an image signal issued by the host computer 97 are transmitted to a controller 10 serving as a control unit, and image formation is executed in the image forming apparatus 100 by the controller 10 controlling various units. The control will be described below.

As illustrated in FIG. 1, the image forming apparatus 100 according to the present example embodiment is an intermediate transfer system color image forming apparatus that uses an electrophotographic system, and includes first, second, third, and fourth image forming units 64*a*, 64*b*, 64*c*, and 64*d* as a plurality of image forming units. The first, second, third, and fourth image forming units 64*a*, 64*b*, 64*c*, and 64*d* are image forming units for respectively forming images with the respective colors of yellow (Y), magenta (M), cyan C, and black (K). These four image forming units 64*a*, 64*b*, 64*c*, and 64*d* are arranged in a line at a fixed interval. In the present example embodiment, the configurations of the first to fourth image forming units 64*a* to 64*d* are substantially the same except that the color of used toner varies. Thus, hereinafter, when distinction is not particularly required, alphabetical letters "a", "b", "c", and "d" added to the reference numerals in the drawings for indicating colors will be omitted, and the components will be collectively described.

As illustrated in FIG. 1, an image forming unit 64 includes a drum-shaped electrophotographic photosensitive member (hereinafter, will be referred to as a photosensitive drum) 56 serving as an image bearing member, a charging roller 57 serving as a charging member, a development unit 5 serving as a development member and including a development roller 58, and a cleaning unit 61. The photosensitive drum 56 is rotationally driven at a predetermined circumferential speed (process speed) in an arrow R1 direction indicated in FIG. 1. Near the image forming unit 64, an exposure unit 60 (laser scanner) that emits light is arranged at a position on the downstream side of the charging roller 57 and on the upstream side of the development unit 5 in the rotational direction of the photosensitive drum 56.

The charging roller 57 is in contact with the photosensitive drum 56 by predetermined pressure contact force, and uniformly charges the surface of the photosensitive drum 56 to a predetermined potential by predetermined voltage being applied from a charging power source 400 (illustrated in FIG. 2). In the present example embodiment, the photosensitive drum 56 is charged by the charging roller 57 to negative polarity. In the present example embodiment, the description has been given of a contact charging method of charging the photosensitive drum 56 in a state in which the charging roller 57 is in contact with the photosensitive drum 56, but the charging method is not limited to this, and a noncontact charging method such as a corona charging method may be used as a method of charging the photosensitive drum 56.

By exposing the surface of the photosensitive drum 56, the exposure unit 60 forms an electrostatic latent image corresponding to image information on the surface of the photosensitive drum 56 charged by the charging roller 57. More specifically, in the exposure unit 60, laser light modulated in accordance with a time-series electric digital pixel signal of image information input from the host computer 97 is output from a laser output unit, and the laser light is emitted onto the surface of the photosensitive drum 56 via a reflection mirror.

The development unit 5 according to the present example embodiment uses a single-component contact development method as a development method, and includes the development roller 58 serving as a toner bearing member. By the development roller 58 being rotationally driven by a drive source (not illustrated), toner borne by the development roller 58 in a thin-layer state is conveyed to a counter portion (development portion) at which the photosensitive drum 56 and the development roller 58 face each other. Then, by voltage being applied from a development power source 500 (illustrated in FIG. 2) to the development roller 58, the electrostatic latent image formed on the photosensitive drum 56 by the exposure unit 60 is developed as a toner image. In the present example embodiment, normal charge polarity of toner is negative polarity, and a toner image is developed on the photosensitive drum 56 using a reversal development method of causing toner charged to the same polarity as the charge polarity of the photosensitive drum 56 to adhere to a position corresponding to the electrostatic latent image formed by the exposure unit 60.

In the development units 5*a*, 5*b*, 5*c*, and 5*d*, yellow toner, magenta toner, cyan toner, and black toner are respectively stored. In the configuration of the image forming apparatus 100 according to the present example embodiment, in a full color image formation mode in which image formation is performed using all of the image forming units 64*a* to 64*d*, all the development rollers 58*a* to 58*d* are in contact with the respective photosensitive drums 56*a* to 56*d* in the development units 5*a* to 5*d*. Meanwhile, in a monocolor (monochromatic) image formation mode in which image formation is performed using only the image forming unit 64*d*, the development roller 58*d* is in contact with the photosensitive drum 56*d* and the development rollers 58*a* to 58*c* are separated from the photosensitive drums 56*a* to 56*c*. This is for preventing deterioration of the development rollers 58*a* to 58*c* and consumption of toner in the image forming units 64*a* to 64*c* in which image formation is not performed.

The cleaning unit 61 includes a cleaning blade serving as a cleaning member that is in contact with the photosensitive drum 56, and a waste toner box that stores toner collected by the cleaning blade. The cleaning unit 61 collects toner remaining on the photosensitive drum 56.

If a start signal of an image forming operation is issued in the image forming apparatus 100, the photosensitive drum 56 is rotationally driven in the arrow R1 direction illustrated in FIG. 1. While the photosensitive drum 56 is being rotated, the photosensitive drum 56 is uniformly charged by the charging roller 57 to a predetermined potential at predetermined polarity (negative polarity in the present example embodiment), and is exposed by the exposure unit 60 in accordance with an image signal. Electrostatic latent images corresponding to respective color component images of a target color image are thereby formed on the respective photosensitive drums 56. Subsequently, the electrostatic latent image is developed by the development unit 5 in the development portion and visualized as a toner image. Normal charge polarity of toner stored in the development unit 5 is negative polarity.

An intermediate transfer belt 54 serving an intermediate transfer member is an endless movable belt member, and is stretched by tension rollers 55*a*, 55*b*, and 55*c* serving as a support member. The intermediate transfer belt 54 is rotationally driven in an arrow R2 direction indicated in FIG. 1 at substantially the same circumferential speed as the photosensitive drum 56. The toner image formed on the photosensitive drum 56 is primarily transferred from the photosensitive drum 56 onto the intermediate transfer belt 54 when the toner image passes through a primary transfer portion N1 at which the photosensitive drum 56 and the intermediate transfer belt 54 are in contact with each other. Primary transfer remaining toner remaining on the photosensitive drum 56 after the primary transfer is removed by the cleaning unit 61*a*, and the photosensitive drum 56 is used again for subsequent image forming processes starting from charging.

On the inner circumferential surface of the intermediate transfer belt 54, primary transfer members 59*a* to 59*d* each being a conductive brush member are disposed at a position corresponding to the respective photosensitive drums 56 of the image forming units 64. A primary transfer power source 200 is connected to the primary transfer members 59, and the primary transfer power source 200 can apply voltage of positive polarity or negative polarity to the primary transfer members 59. The primary transfer members 59 can be in contact with and separated from the intermediate transfer belt 54. In image formation, voltage of opposite polarity (positive polarity in the present example embodiment) to normal charge polarity of toner is applied from the primary transfer power source 200 to the primary transfer members 59 in a state in which the primary transfer members 59 are in contact with the intermediate transfer belt 54. The toner images formed on the photosensitive drum 56 are thereby primarily transferred onto the intermediate transfer belt 54.

As illustrated in FIG. 1, in the present example embodiment, voltage is applied from one common power source, the primary transfer power source 200, to the primary transfer members 59*a* to 59*d*. In this manner, by using the common primary transfer power source 200, for applying voltage to the plurality of primary transfer members 59, cost-reduction in the image forming apparatus and a space-saving in a power board can be achieved.

The toner images with the respective colors formed in the respective image forming units 64 are primarily transferred sequentially onto the intermediate transfer belt 54 in an overlapped manner at the primary transfer portions N1. After that, the four-color toner images on the intermediate transfer belt 54 are secondarily transferred collectively onto the surface of a transfer material P fed by a sheet feeding roller 51, when the toner images pass through a secondary transfer portion N2 formed by the intermediate transfer belt 54 and a secondary transfer roller 63.

In the present example embodiment, as the secondary transfer roller 63 serving as a secondary transfer member, a roller having an outer diameter of 18 mm is used. The roller is formed by covering a nickel plated steel rod having an outer diameter of 8 mm with a foam sponge member mainly containing nitrile-butadiene rubber (NBR) and epichlorohydrin rubber. A volume resistance and a thickness of the foam sponge member are adjusted to $10^8$ Ω·cm and 5 mm, respectively. The secondary transfer roller 63 forms the secondary transfer portion N2 by being in contact with the intermediate transfer belt 54 by pressure force of 50 N. The secondary transfer roller 63 is rotationally driven by the rotation of the intermediate transfer belt 54. When the toner images are secondarily transferred from the intermediate transfer belt 54 onto the transfer material P at the secondary transfer portion N2, voltage of 1800 to 2300 V is applied from a secondary transfer power source 300 to the secondary transfer roller 63.

After that, the transfer material P bearing the four-color toner images is introduced into a fixing unit 62. The four-color toner images are melted and mixed in color by being heated and pressed in the fixing unit 62, so that the four-color toner images are fixed on the transfer material P. Secondary transfer remaining toner remaining on the intermediate transfer belt 54 after the secondary transfer is charged by a cleaning brush 65, and moves in accordance with the movement of the intermediate transfer belt 54. After that, by being reversely transferred from the intermediate transfer belt 54 onto the photosensitive drum 56 at the primary transfer portion N1, the toner is removed from the intermediate transfer belt 54 and collected by the cleaning unit 61 of the photosensitive drum 56. Through the above operations, a full color image is formed on the transfer material P.

[Example Control of Image Forming Apparatus]

FIG. 2 is a block diagram illustrating a configuration of the controller 10 serving as a control unit that controls the image forming apparatus 100 according to the present example embodiment. If image information and a start signal of an image forming operation are transmitted from the host computer 97 to the image forming apparatus 100, the controller 10 receives each image signal converted by a video controller 98. Then, the controller 10 executes the image forming operation by controlling each control unit (an exposure control unit 101, a charging control unit 102, a development control unit 103).

The controller 10 includes a central processing unit (CPU) 150 serving as a control unit. The CPU 150 incorporates a read-only member (ROM) 151 and a random access memory (RAM) 152. In accordance with control programs stored in the ROM 151, the CPU 150 comprehensively controls the exposure control unit 101, the charging control unit 102, the development control unit 103, a primary transfer control unit 104, and a secondary transfer control unit 105. An environment table and various tables for transfer control are stored in the ROM 151. These stored tables are called from the CPU 150 and reflected based on environment information detected by an environment sensor 106 serving as a detection unit that detects temperature and humidity in an installation environment of the image forming apparatus 100.

The RAM 152 temporarily holds control data and is also used as a work area for calculation processing related to control. The charging control unit 102 controls voltage output from the charging power source 400. The development control unit 103 controls voltage output from the development power source 500. The primary transfer control unit 104 controls the primary transfer power source 200 and controls voltage output from the primary transfer power source 200 based on a current value detected by a current detection circuit 201. The secondary transfer control unit 105 controls the secondary transfer power source 300, and controls voltage output from the secondary transfer power source 300 based on a current value detected by a current detection circuit (not illustrated).

[Contact/Separation Operation of Primary Transfer Member]

Figure 3A:
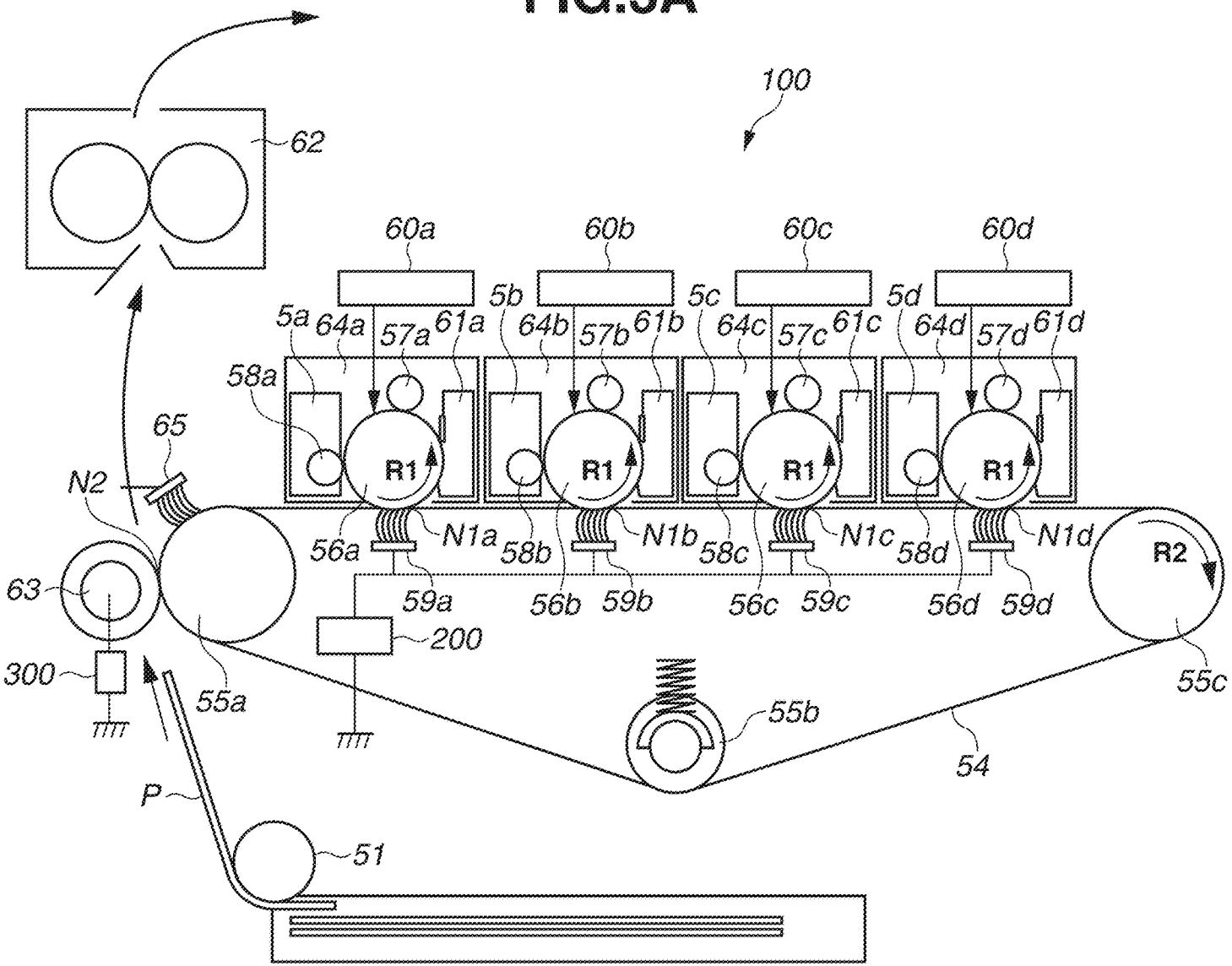
FIGS. 3A and 3B are schematic diagrams illustrating contact and separation of a primary transfer member in each mode according to the first example embodiment.

The image forming apparatus 100 includes a unit (not illustrated) that brings the primary transfer members 59*a*, 59*b*, 59*c*, and 59*d* into contact with the intermediate transfer belt 54 or separate the primary transfer members 59*a*, 59*b*, 59*c*, and 59*d* from the intermediate transfer belt 54. The controller 10 can selectively perform image formation of either a full color image formation mode (hereinafter, will be referred to as a full color mode) or a monocolor image formation mode (hereinafter, will be referred to as a monochrome mode). FIG. 3A is a schematic diagram illustrating the full color mode according to the present example embodiment, and FIG. 3B is a schematic diagram illustrating the monochrome mode according to the present example embodiment.

As illustrated in FIG. 3A, in the full color mode, image formation is performed in a state in which the primary transfer members 59*a* to 59*d* are brought into contact with the intermediate transfer belt 54 by a contact/separation mechanism (not illustrated). In other words, in the full color mode, a first state in which the primary transfer members 59*a* to 59*d* are in contact with the intermediate transfer belt 54 is formed. Meanwhile, in the monochrome mode, as illustrated in FIG. 3B, image formation is performed in a state in which only the primary transfer member 59*d* is brought into contact with the intermediate transfer belt 54 by the contact/separation mechanism (not illustrated). In other words, in the monochrome mode, a second state in which the primary transfer member 59*d* is in contact with the intermediate transfer belt 54 and the primary transfer members 59*a* to 59*c* are separated from the intermediate transfer belt 54 is formed.

Figure 3B:
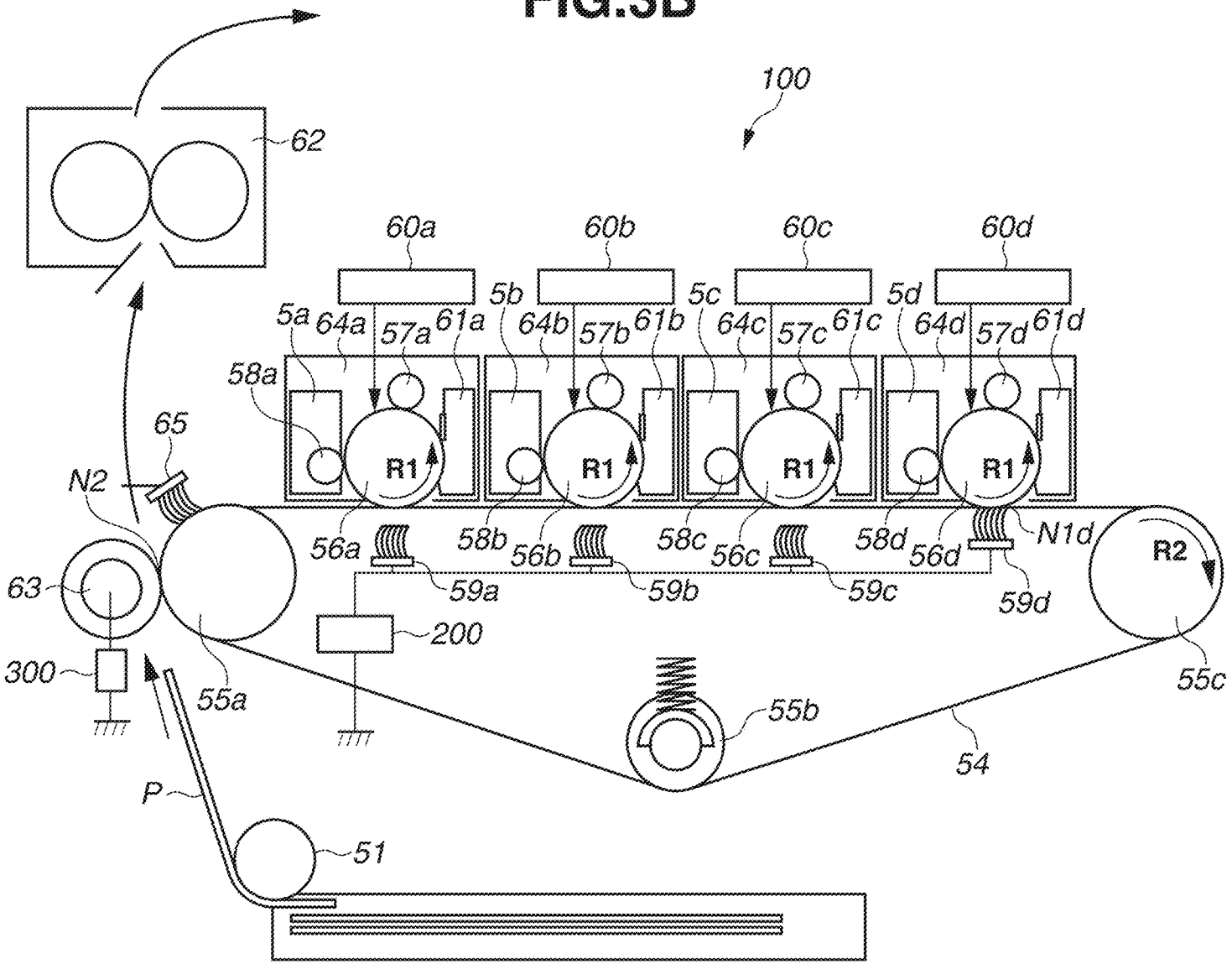

In the monochrome mode, as illustrated in FIG. 3B, the state in which the primary transfer members 59*a* to 59*d* are brought into contact with the intermediate transfer belt 54 by the contact/separation mechanism (not illustrated) is cancelled. As a result, when image formation is performed in the monochrome mode, driving of each member in the image forming units 64*a* to 64*c* can be stopped. By employing such a configuration, unnecessary operations can be reduced or prevented and the operating life of the image forming units 64*a* to 64*c* can be increased.

As a contact/separation mechanism of the primary transfer member 59 and the intermediate transfer belt 54, for example, a configuration that uses an urging unit such as a spring can be considered. In such a configuration, by cancelling an urged state caused by the spring, the primary transfer members 59 can be separated from the intermediate transfer belt 54.

[Example Pathway of Current Flowing in Primary Transfer Portion]

Figure 4A:
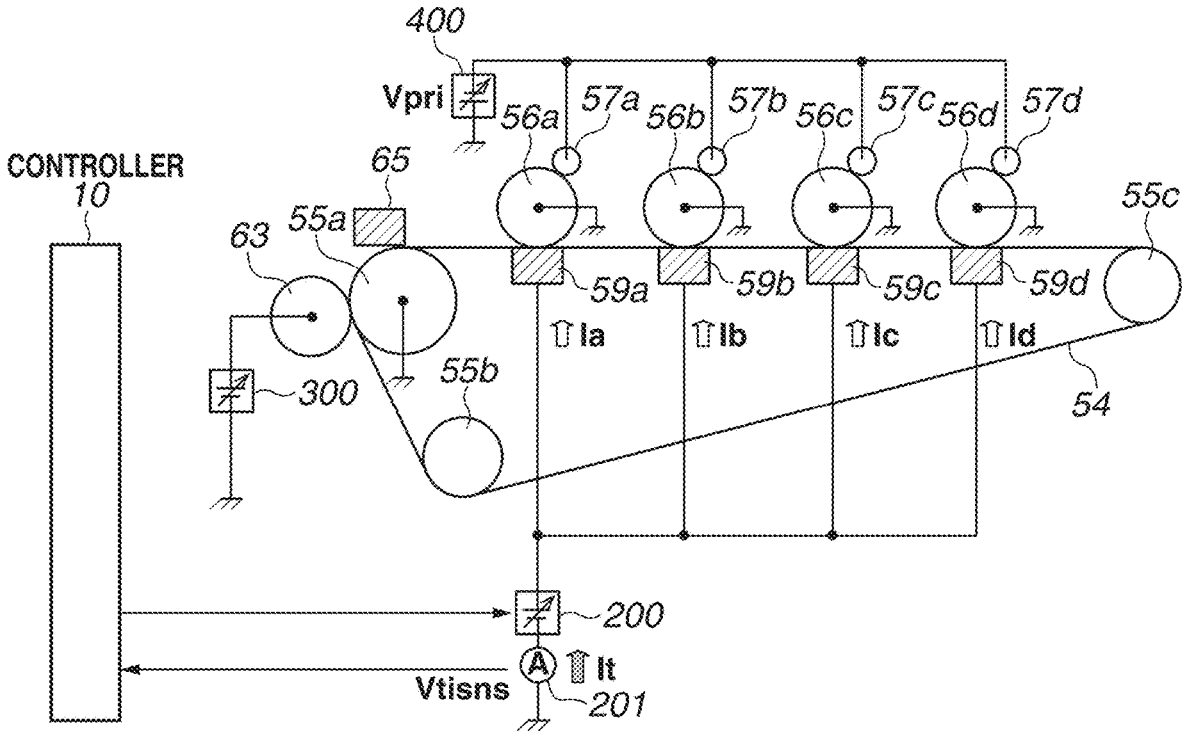
FIGS. 4A and 4B are schematic diagrams illustrating a current flowing in a primary transfer member in a full color mode according to the first example embodiment.
Figure 4B:
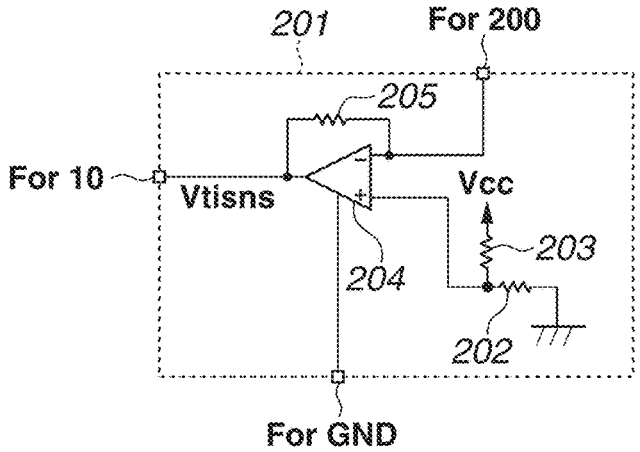
Figure 5:
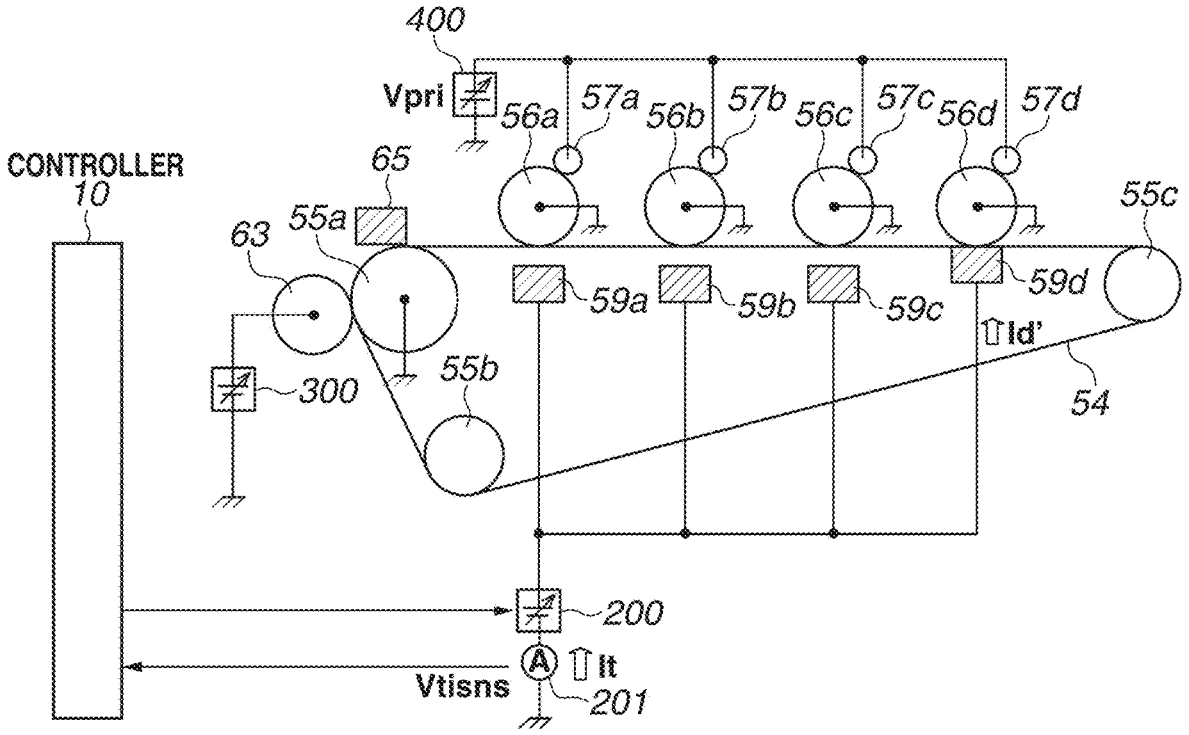
FIG. 5 is a schematic diagram illustrating a current flowing in a primary transfer member in a monochrome mode according to the first example embodiment.

A pathway of a current flowing in the primary transfer portion N1 in the full color mode and the monochrome mode will be described with reference to FIGS. 4A, 4B, and 5. FIG. 4A is a schematic diagram illustrating a pathway of a current flowing in the primary transfer portion N1 in the full color mode, and FIG. 4B is a schematic diagram illustrating the current detection circuit 201. FIG. 5 is a schematic diagram illustrating a pathway of a current flowing in the primary transfer portion N1 in the monochrome mode. The characteristics of the present example embodiment lie in that voltage is supplied from the common primary transfer power source 200 to the plurality of primary transfer members 59, and a primary transfer current flowing in each of the primary transfer portions N1 is detected by the common current detection circuit 201 (detection unit).

<Example Full Color Mode>

By active transfer voltage control (ATVC) executed in a pre-rotation process of a job, the controller 10 sets a value of primary transfer voltage to be applied from the primary transfer power source 200 to the primary transfer members 59*a*, 59*b*, 59*c*, and 59*d* in the primary transfer of the job. In the following description, in the case of performing the same control on the primary transfer members 59*a*, 59*b*, 59*c*, and 59*d*, alphabetical letters "a" to "d" for distinguishing between the primary transfer members 59*a* to 59*d* corresponding to the respective image forming units 64*a* to 64*d* will be omitted, and the primary transfer members 59*a* to 59*d* will be simply referred to as the primary transfer members 59.

In the ATVC control, first of all, voltage having been subjected to constant current control using a predetermined current value (target current value) is applied from the primary transfer power source 200 to the primary transfer members 59. In this process, the current detection circuit 201 obtains a total value of currents flowing toward the primary transfer portions N1, i.e., a total value of currents flowing in the primary transfer members 59. Based on the detection result of the current detection circuit 201, the controller 10 obtains a value of voltage applied from the primary transfer power source 200 to the primary transfer members 59, and then, sets a value of primary transfer voltage based on the voltage value.

The current detection circuit 201 will now be described with reference to FIG. 4B. The current detection circuit 201 is electrically connected between the primary transfer power source 200 and a ground. The current detection circuit 201 includes an operational amplifier 204 and resistors 202, 203, and 205 that are connected to the primary transfer power source 200, and feeds back an output of the operational amplifier 204 to the controller 10. Voltage obtained by dividing power source voltage Vcc by the resistors 202 and 203 (hereinafter, the voltage will be referred to as voltage Vt) is input to a positive polarity input of the operational amplifier 204. A voltage value of the voltage Vt is set to about several voltages considering the rating of the operational amplifier 204. Because the operational amplifier 204 forms a negative feedback circuit using the resistor 205, a potential difference between a positive polarity input and a negative polarity input of the operational amplifier 204 becomes 0 V. In other words, the positive polarity input and the negative polarity input of the operational amplifier 204 have the same potential as the voltage Vt.

If an output of the primary transfer power source 200 is turned on, voltage is applied to the primary transfer members 59, and as illustrated in FIG. 4A, currents Ia, Ib, Ic, and Id respectively flow in the primary transfer members 59*a*, 59*b*, 59*c*, and 59*d*. The current Ia is a current flowing to the ground (GND) via the primary transfer member 59*a* and the photosensitive drum 56*a*. Similarly to the current Ia, the currents Ib to Id are currents flowing to the GND via the respective primary transfer members 59*b* to 59*d* and the respective photosensitive drums 56*b* to 56*d*. A total value of the currents Ia to Id flowing in the respective primary transfer members 59 is described as a total current It, and the total current It flows from the GND to the operational amplifier 204. The total current It returns from an output terminal of the operational amplifier 204 to the primary transfer power source 200 via the resistor 205. By the current pathway described above, voltage is generated at both ends of the resistor 205, and an output of the operational amplifier 204 (hereinafter, the voltage will be referred to as voltage Visns) becomes a voltage value represented by the following formula 1.

$$Vtisns = Vt + R205 \times It \quad (1)$$

In the formula, R205 denotes a resistance value of the resistor 205. Formula 1 representing information associating the voltage value of the voltage Vtisns and the total current It indicating a total value of currents flowing in the primary transfer members 59 is prestored in the ROM 151 of the controller 10. Based on Formula 1 and the voltage Vtisns output from the current detection circuit 201, the controller 10 can detect, as the total current It, values of currents flowing in the respective primary transfer members 59.

Then, a value of primary transfer voltage is set based on a value (generated voltage value) of the voltage generated at both ends of the resistor 205, and the set primary transfer voltage is output from the primary transfer power source 200 to the primary transfer members 59 when the toner images are primarily transferred from the photosensitive drums 56 onto the intermediate transfer belt 54. In the present example embodiment, when primary transfer is performed, constant voltage control of applying predetermined primary transfer voltage set using the above-described method, from the primary transfer power source 200 to the primary transfer members 59 is executed.

The value of primary transfer voltage set in the ATVC control may be a generated voltage value itself in the ATVC control, or may be determined in accordance with the generated voltage value thereof based on a calculation formula or a lookup table (LUT) obtained in advance. In the present example embodiment, the primary transfer voltage is controlled by the controller 10 based on a detection signal (voltage signal) from the current detection circuit 201 for each condition such as process speed or environment referring to process speed information or environment information. In other words, in the present example embodiment, the above-described plurality of target current values is set in accordance with a condition such as process speed or environment. An execution timing of the ATVC control is not limited to the time of the pre-rotation process until the time when image formation of the job is started, and the ATVC control can be executed at an any timing as long as image formation is not performed.

<Example Monochrome Mode>

Similarly to the above-described full color mode, by the ATVC control executed in the pre-rotation process of a job, the controller 10 sets a value of primary transfer voltage to be applied from the primary transfer power source 200 to the primary transfer members 59*a*, 59*b*, 59*c*, and 59*d* in the primary transfer of the job.

If an output of the primary transfer power source 200 is turned on, voltage is applied to the primary transfer members 59*a*, 59*b*, 59*c*, and 59*d*. In this process, as illustrated in FIG. 5, while a current Id' flows in the primary transfer member 59*d*, currents do not flow in the primary transfer members 59*a* to 59*c*. More specifically, because the intermediate transfer belt 54 and the primary transfer members 59*a* to 59*c* are in a separated state, current pathways connected to the GND via the primary transfer members 59*a* to 59*c* and the photosensitive drums 56*a* to 56*c* are cut off, and the currents Ia to Ic illustrated in FIG. 4A do not flow. Meanwhile, because the intermediate transfer belt 54 and the primary transfer member 59*d* are in a contact state, by a current pathway connected to the GND via the primary transfer member 59*d* and the photosensitive drum 56*d*, the current Id' flows in the primary transfer member 59.

The current Id' flowing in the primary transfer member 59*d* flows from the GND to the operational amplifier 204 as the total current It, and then, returns to the primary transfer power source 200 from the output terminal of the operational amplifier 204 via the resistor 205. Based on Formula 1 and the voltage Vtisns output from the current detection circuit 201, the controller 10 can detect a value of a current flowing in the primary transfer member 59*d*.

[Relationship between Primarily Transfer Current and Primary Transfer Voltage]

Next, a relationship between primary transfer voltage applied to the primary transfer member 59 and the total current It detected by the current detection circuit 201 under each condition will be described with reference to FIGS. 6A to 6F.

Figure 6A:
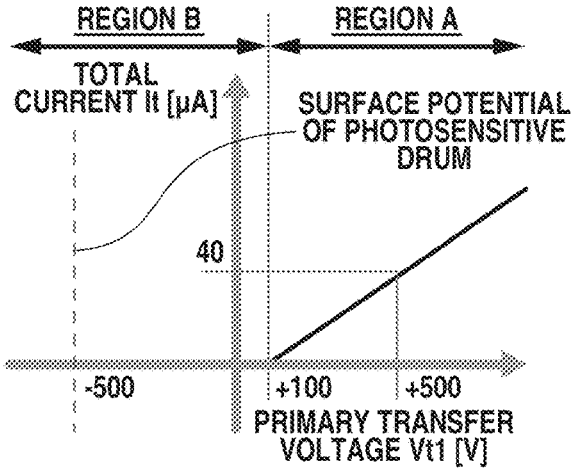
FIGS. 6A, 6B, 6C, 6D, 6E, and 6F are schematic diagrams each illustrating a relationship between voltage applied to a primary transfer member and a current flowing in the primary transfer member according to the first example embodiment.
Figure 6B:
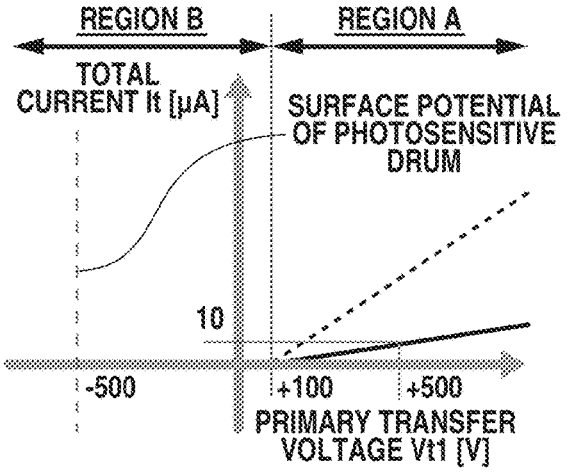

FIG. 6A illustrates a graph indicating a relationship between voltage (the primary transfer voltage Vt1) output from the primary transfer power source 200 to the primary transfer members 59 and the total current It detected by the current detection circuit 201 in the full color mode according to the present example embodiment. FIG. 6B illustrates a graph indicating a relationship between voltage (the primary transfer voltage Vt1) output from the primary transfer power source 200 to the primary transfer members 59 and the total current It detected by the current detection circuit 201 in the monochrome mode according to the present example embodiment.

Under the condition illustrated in FIG. 6A, after the photosensitive drum 56 is charged by the charging roller 57 to −500 [V] similarly to the image formation time, laser exposure of an image formation region is not performed by the exposure unit 60. The surface potential is thereby set to about −500 [V]. The primary transfer member 59 is brought into contact with the intermediate transfer belt 54, and an intermediate transfer belt with a surface resistance ρs of $1.0\times10^{9.5}$ [Ω/□] is used as the intermediate transfer belt 54. The measurement has been performed under the environment with room temperature of 25° C. and humidity of 80%.

As illustrated in FIG. 6A, a relationship between the primary transfer voltage Vt1 and the total current It can be considered using two divided regions including a region A and a region B. The region A is a region in which the primary transfer voltage Vt1 is larger than +100 [V], and the region B is a region in which the primary transfer voltage Vt1 is smaller than or equal to +100 [V]. When the primary transfer voltage Vt1 is +500 [V], the total current It becomes 40 [μA].

In the region A, if the primary transfer voltage Vt1 (+100 [V] or more) is applied from the primary transfer power source 200 to the primary transfer member 59, a potential difference between the surface of the photosensitive drum 56 and the surface of the intermediate transfer belt 54 exceeds a discharge threshold (about 600 [V] in the present example embodiment). Thus, discharge is generated between the surface of the photosensitive drum 56 and the surface of the intermediate transfer belt 54, and a current flows in the photosensitive drum 56.

Meanwhile, in the region B, even if the primary transfer voltage Vt1 is applied from the primary transfer power source 200 to the primary transfer member 59, a potential difference between the surface of the photosensitive drum 56 and the surface of the intermediate transfer belt 54 is smaller than or equal to the discharge threshold. Thus, a current does not flow in the photosensitive drum 56 because discharge is not generated between the surface of the photosensitive drum 56 and the surface of the intermediate transfer belt 54. The relationship between the primary transfer voltage Vt1 and the total current It detected by the current detection circuit 201 becomes a proportional relationship in which the primary transfer voltage Vt1 passes through the position of +100 [V].

FIG. 6B will be described. As already described with reference to FIG. 5, in the monochrome mode, because the primary transfer members 59*a* to 59*c* are separated from the intermediate transfer belt 54, a current flows only in the primary transfer member 59*d*. As a result, as illustrated in FIG. 6B, when the primary transfer voltage Vt1 is +500 [V], the total current It becomes 10 [μA]. In this manner, in the monochrome mode, the graph indicating the relationship between the primary transfer voltage Vt1 and the total current It detected by the current detection circuit 201 has a slope smaller than that in FIG. 6A.

In the region A, if the primary transfer voltage Vt1 of +100 [V] or more is applied from the primary transfer power source 200 to the primary transfer member 59, a potential difference between the surface of the photosensitive drum 56*d* and the surface of the intermediate transfer belt 54 exceeds the discharge threshold, and a current flows in the primary transfer portion N1*d*. Meanwhile, in the region B, similarly to FIG. 6A, a current does not flow in the photosensitive drum 56. The relationship between the primary transfer voltage Vt1 and the total current It detected by the current detection circuit 201 becomes a proportional relationship in which the primary transfer voltage Vt1 passes through the position of +100 [V].

As described above with reference to FIGS. 6A and 6B, the relationship between the total current It and the primary transfer voltage Vt1 changes in accordance with a contact/separated state of the intermediate transfer belt 54 and the primary transfer member 59.

Figure 6C:
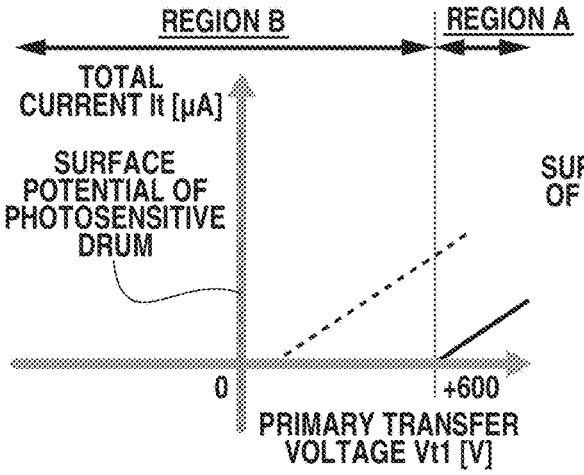
Figure 6D:
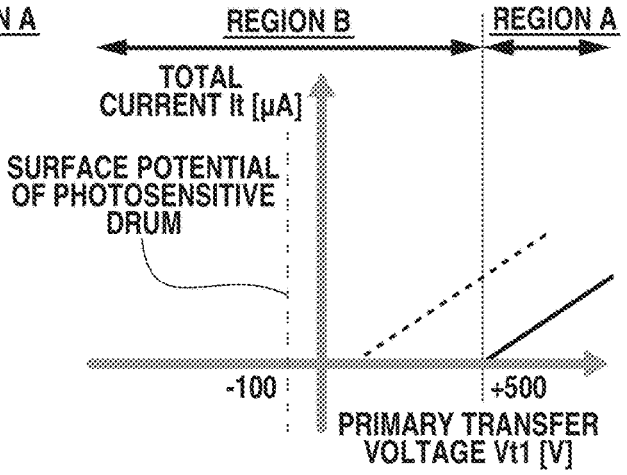

FIG. 6C illustrates a graph indicating a relationship between the primary transfer voltage Vt1 and the total current It in a case where the photosensitive drum 56 is not charged by the charging roller 57 in the full color mode of the image forming apparatus 100. FIG. 6D illustrates a graph indicating a relationship between the primary transfer voltage Vt1 and the total current It in a case where the surface of the photosensitive drum 56 is exposed by the exposure unit 60 and the surface potential of the photosensitive drum 56 is set to −100 [V] in the full color mode of the image forming apparatus 100.

As illustrated in FIG. 6C, in the region A, if the primary transfer voltage Vt1 of +600 [V] or more is applied from the primary transfer power source 200 to the primary transfer member 59, a potential difference between the surface of the photosensitive drum 56 and the surface of the intermediate transfer belt 54 exceeds the discharge threshold. At this time, discharge is generated between the surface of the photosensitive drum 56 and the surface of the intermediate transfer belt 54, and a current flows in the photosensitive drum 56. Meanwhile, in the region B, similarly to the region B in FIG. 6A, a current does not flow in the photosensitive drum 56. Thus, under the condition illustrated in FIG. 6C, the relationship between the primary transfer voltage Vt1 and the total current It detected by the current detection circuit 201 becomes a proportional relationship in which the primary transfer voltage Vt1 passes through the position of +600 [V].

As illustrated in FIG. 6D, if the surface potential of the photosensitive drum 56 is set to −100 [V] by the exposure unit 60, in the region A, a current flows in the photosensitive drum 56 in a case where the primary transfer voltage Vt1 applied to the primary transfer member 59 is +500 [V] or more. Meanwhile, in the region B, similarly to FIG. 6A, a current does not flow in the photosensitive drum 56. Thus, the relationship between the primary transfer voltage Vt1 and the total current It detected by the current detection circuit 201 becomes a proportional relationship in which the primary transfer voltage Vt1 passes through the position of +500 [V].

As compared with FIG. 6A, under the conditions illustrated in FIGS. 6C and 6D, the slopes of the graphs indicating the relationship between the primary transfer voltage Vt1 and the total current It detected by the current detection circuit 201 become substantially equal. Meanwhile, a boundary between the region A and the region B, i.e., a value of the primary transfer voltage Vt1 at which a current starts to flow in the photosensitive drum 56, varies. More specifically, under the conditions illustrated in FIGS. 6C and 6D, a value of voltage applied to the primary transfer member 59 for flowing a current to the photosensitive drum 56 via the primary transfer member 59 is a value with an absolute value larger than that under the condition illustrated in FIG. 6A. In addition, under the condition illustrated in FIG. 6C, a value of voltage applied to the primary transfer member 59 for flowing a current to the photosensitive drum 56 via the primary transfer member 59 is a value with an absolute value larger than the absolute value under the condition illustrated in FIG. 6D.

As described above with reference to FIGS. 6C to 6D, the relationship between the total current It and the primary transfer voltage Vt1 changes in accordance with the surface potential of the photosensitive drum 56.

Figure 6E:
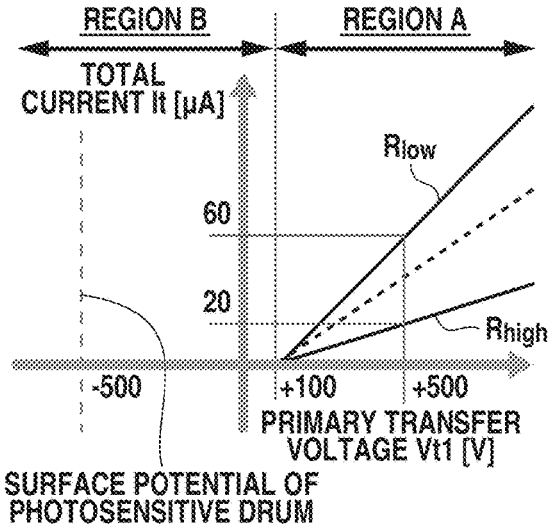

FIG. 6E illustrates a graph indicating a relationship between the primary transfer voltage Vt1 and the total current It in the full color mode in a case where a usage environment of the image forming apparatus 100 changes. In FIG. 6E, in a case where the primary transfer voltage Vt1 applied to the primary transfer member 59 is +100 [V] or more, a current flows in the photosensitive drum 56 irrespective of a resistance value of the intermediate transfer belt 54. In other words, under each condition illustrated in FIG. 6E, similarly to FIG. 6A, the relationship between the primary transfer voltage Vt1 and the total current It detected by the current detection circuit 201 becomes a proportional relationship in which the primary transfer voltage Vt1 passes through the position of +100 [V].

In some cases, a surface resistance of the intermediate transfer belt 54 varies in accordance with a change in usage environment of the image forming apparatus 100. In FIG. 6A, a surface resistance ρs of the intermediate transfer belt 54 is $1.0\times10^{9.5}$ [Ω/□]. Meanwhile, a graph $R_{LOW}$ in FIG. 6E indicates a relationship between the primary transfer voltage Vt1 and the total current It that is obtainable when a surface resistance ρs of the intermediate transfer belt 54 decreases to $1.0\times10^{7}$ [Ω/□]. In addition, a graph $R_{High}$ in FIG. 6E indicates a relationship between the primary transfer voltage Vt1 and the total current It that is obtainable when a surface resistance ρs of the intermediate transfer belt 54 increases to $1.0\times10^{11}$ [Ω/□].

As indicated by the graph $R_{LOW}$, in a case where a surface resistance ρs of the intermediate transfer belt 54 decreases to $1.0\times10^{7}$ [Ω/□], when the primary transfer voltage Vt1 is +500 [V], the total current It becomes 60 [μA]. As for the graph $R_{LOW}$, because a resistance value of the intermediate transfer belt 54 decreases, as compared with FIG. 6A, a current flows in the photosensitive drum 56 more easily. Thus, the graph indicating the relationship between the primary transfer voltage Vt1 and the total current It detected by the current detection circuit 201 has a slope larger than the slope in FIG. 6A.

Then, as indicated by the graph $R_{High}$, in a case where the usage environment of the intermediate transfer belt 54 changes and the surface resistance ρs increases to $1.0\times10^{11}$ [Ω/□], when the primary transfer voltage Vt1 is +500 [V], the total current It becomes 20 [μA]. As for the graph $R_{LOW}$, because a resistance value of the intermediate transfer belt 54 increases, as compared with FIG. 6A, a current flows in the photosensitive drum 56 less easily. Thus, the graph indicating the relationship between the primary transfer voltage Vt1 and the total current It detected by the current detection circuit 201 has a slope smaller than the slope in FIG. 6A.

Figure 6F:
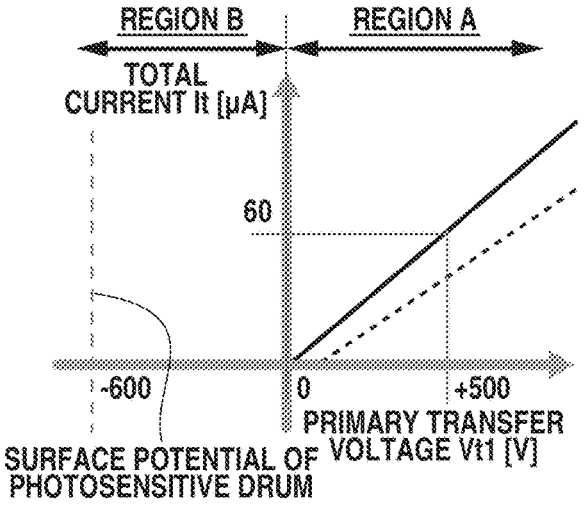

FIG. 6F will be described. FIG. 6F illustrates a graph indicating a relationship between the primary transfer voltage Vt1 and the total current It in the full color mode in a case where a surface film thickness of the photosensitive drum 56 becomes thinner by continuously using the image forming apparatus 100. If a film thickness of the photosensitive drum 56 becomes thinner, as a potential difference generated in an air gap between the charging roller 57 and the photosensitive drum 56 becomes larger, an absolute value of the surface potential of the charged photosensitive drum 56 becomes larger. More specifically, as illustrated in FIG. 6F, the surface potential of the charged photosensitive drum 56 becomes about −600 [V].

As a result, in FIG. 6F, in the region A, if the primary transfer voltage Vt1 of +0 [V] or more is applied from the primary transfer power source 200 to the primary transfer member 59, a potential difference between the surface of the photosensitive drum 56 and the surface of the intermediate transfer belt 54 exceeds the discharge threshold. At this time, discharge is generated between the surface of the photosensitive drum 56 and the surface of the intermediate transfer belt 54, and a current flows in the photosensitive drum 56. Thus, under the condition illustrated in FIG. 6F, the relationship between the primary transfer voltage Vt1 and the total current It detected by the current detection circuit 201 becomes a proportional relationship in which the primary transfer voltage Vt1 passes through the position of 0 [V].

As compared with FIG. 6A, under the condition illustrated in FIG. 6F, a current flows in the photosensitive drum 56 more easily, and when the primary transfer voltage Vt1 is +500 [V], the total current It becomes 60 [μA]. In other words, as illustrated in FIG. 6F, the graph indicating the relationship between the primary transfer voltage Vt1 and the total current It detected by the current detection circuit 201 has a slope larger than the slope in FIG. 6A.

As described above, as seen from the results of the graphs illustrated in FIGS. 6A to 6F, the relationship between the total current It and the primary transfer voltage Vt1 varies in accordance with a contact/separated state of the intermediate transfer belt 54 and the primary transfer member 59, the surface potential of the photosensitive drum 56, or a resistance value of the intermediate transfer belt 54.

[Example Detection of Contact State between Primary Transfer Member and Intermediate Transfer Belt]

Figure 7:
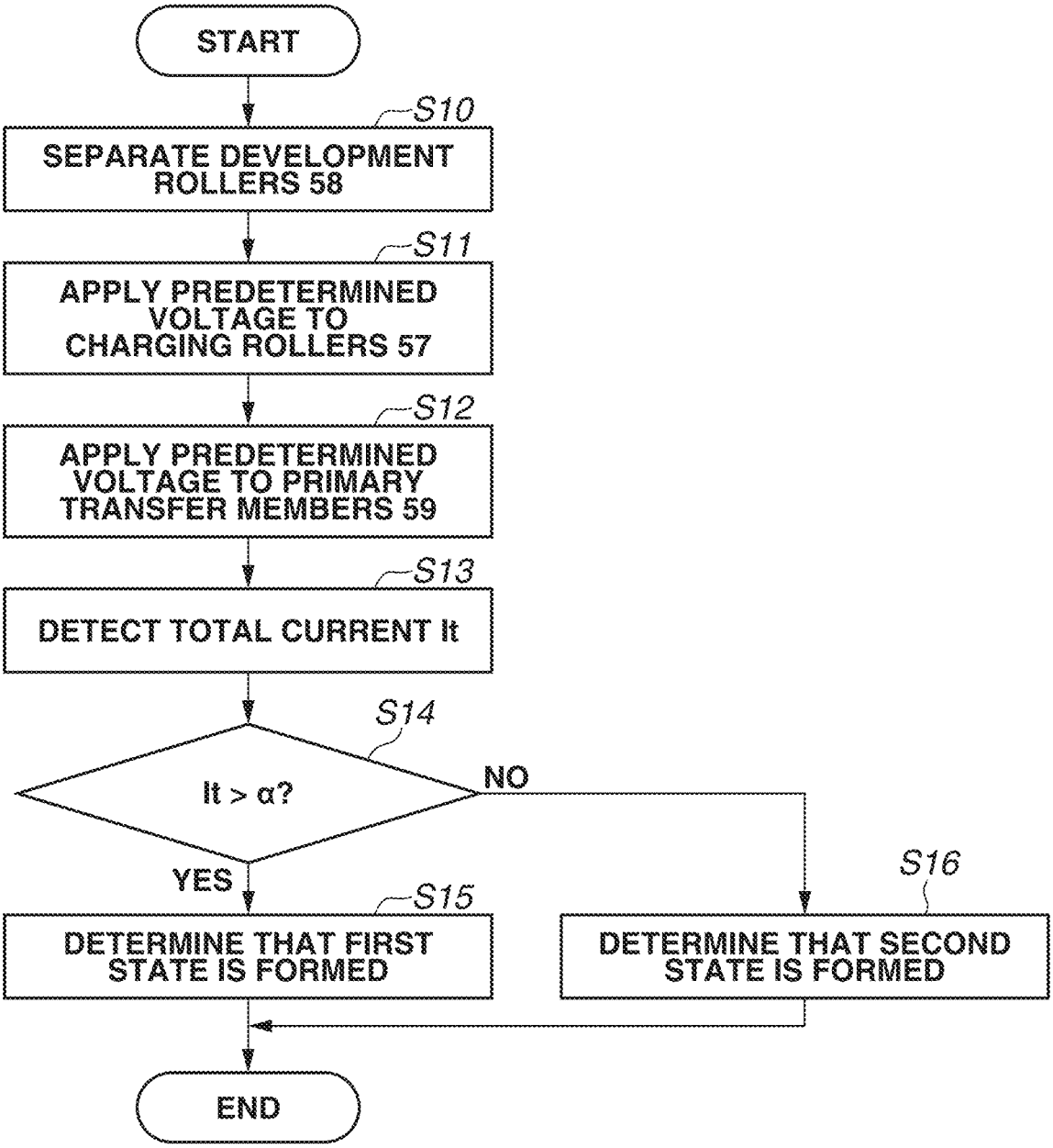
FIG. 7 is a flowchart illustrating a detection method of a contact state between a primary transfer member and an intermediate transfer member according to the first example embodiment.

FIG. 7 is a flowchart illustrating a detection method of a contact state between the primary transfer members 59 and the intermediate transfer belt 54 according to the present example embodiment.

As illustrated in FIG. 7, in the case of detecting a contact state between the primary transfer member 59 and the intermediate transfer belt 54, first of all, in step S10, the development rollers 58 are separated. The surfaces of the photosensitive drums 56 having the surface potential are thereby brought to the positions of the respective primary transfer members 59 without toner adhering to the surfaces. In step S11, predetermined voltage Va is applied from the charging power source 400 to the charging rollers 57*a*, 57*b*, 57*c*, and 57*d*. In step S12, predetermined voltage Vb is applied from the primary transfer power source 200 to the primary transfer members 59. The predetermined voltage Va and the predetermined voltage Vb are determined in accordance with the generated voltage values thereof based on a calculation formula or a lookup table obtained in advance.

In step S13, the current detection circuit 201 detects the total current It, and then, in step S14, values of the total current It and a preset threshold a (first threshold) are compared. The threshold a will be described in detail below. In a case where the value of the total current It is larger than the threshold a (YES in step S14), the processing proceeds to step S15. In step S15, the controller 10 determines that the contact state is the first state in which the primary transfer members 59 are in contact with the intermediate transfer belt 54. Meanwhile, in a case where the total current It is smaller than or equal to the threshold α (NO in step S14), the processing proceeds to step S16. In step S16, the controller 10 determines that the contact state is a state in which only the primary transfer member 59*d* is in contact with the intermediate transfer belt 54. More specifically, in step S16, the controller 10 determines that the contact state is the second state in which the primary transfer member 59*d* and the intermediate transfer belt 54 are in contact with each other, and the primary transfer members 59*a* to 59*c* are separated from the intermediate transfer belt 54.

The threshold α will be described. The threshold α is a preset threshold to be compared with the total current It detected by the current detection circuit 201, and is stored in the ROM 151 illustrated in FIG. 2 in the present example embodiment. The value of the threshold α is to be determined considering a value variation range of the total current It that has been described with reference to FIGS. 6A-6F, in addition to the predetermined voltage Va applied to the charging rollers 57 and the predetermined voltage Vb applied to the primary transfer members 59.

In the present example embodiment, the predetermined voltage Va applied to the charging rollers 57 is determined in such a manner that the surface potential of the photosensitive drum 56 becomes at least −400 [V] or more. Thus, as described above with reference to FIGS. 6C to 6D, there is no need to apply voltage with a larger absolute value as the primary transfer voltage Vt1 applied to the primary transfer member 59. In other words, as described above with reference to FIGS. 6A to 6B, a contact state between the primary transfer member 59 and the intermediate transfer belt 54 can be detected using the primary transfer voltage Vt1 with a lower value.

In the present example embodiment, for detecting the contact and separated states of the primary transfer member 59 and the intermediate transfer belt 54, a value of the predetermined voltage Va is set to −1000 [V] and a value of the predetermined voltage Vb is set to +350 [V]. A value of the threshold α is set to 5 [μA] considering a condition under which the total current It becomes smaller with respect to the primary transfer voltage Vt1. The condition under which the total current It becomes smaller is such a condition that a film thickness of the photosensitive drum 56 is thick or a resistance value of the intermediate transfer belt 54 is high, for example.

According to the configuration of the present example embodiment, a contact state between the primary transfer member 59 and the intermediate transfer belt 54 is determined based on a detection result obtained by the current detection circuit 201 when the surface potential of the photosensitive drum 56 is controlled by the charging roller 57, and voltage is applied from the primary transfer power source 200 to the primary transfer member 59. With this configuration, in the configuration of applying voltage from the primary transfer power source 200 to the plurality of primary transfer members 59, stable detection can be performed in the current detection circuit 201, and a contact state between the primary transfer member 59 and the intermediate transfer belt 54 can be accurately determined.

Furthermore, in the present example embodiment, by controlling the surface potential of the photosensitive drum 56 by the charging roller 57, increase in a value of voltage to be output from the primary transfer power source 200 to the primary transfer member 59 can be reduced or prevented. With this configuration, a decrease in durability that is caused by flowing a current in the primary transfer member 59 and the photosensitive drum 56 can be further reduced or prevented.

Specifically, if the surface of the photosensitive drum 56 is not charged by the charging roller 57, as illustrated in FIG. 6C, voltage of −600 [V] to the primary transfer member 59 is applied to cause a current to flow from the primary transfer member 59 to the photosensitive drum 56. Meanwhile, according to the configuration of the present example embodiment, as illustrated in FIGS. 6A to 6B, by applying voltage of −100 [V] to the primary transfer member 59, a current can flow from the primary transfer member 59 to the photosensitive drum 56, and the current detection circuit 201 can detect the current value.

While, in the present example embodiment, a method of making a distinction between the full color mode and the monochrome mode has been described, the present disclosure can also be used in the case of detecting a mode other than these modes. For example, there can be various combinations of modes such as a two-color mode in which image formation is performed using only the image forming units 64*a* and 64*b* respectively storing yellow toner and magenta toner, and a three-color mode in which image formation is performed using only the image forming units 64*a*, 64*b*, and 64*c* respectively storing yellow toner, magenta toner, and cyan toner. Also in an image forming apparatus having such various color modes, by using the detection method described in the present example embodiment, a primary transfer member that is in contact with an intermediate transfer belt can be identified.

While, in the present example embodiment, the predetermined voltage Va and the predetermined voltage Vb are determined in accordance with the generated voltage values thereof based on a calculation formula or a lookup table obtained in advance, the predetermined voltage Va and the predetermined voltage Vb are not limited to the values determined in this manner. For example, the predetermined voltage Va and the predetermined voltage Vb may be values further corrected in accordance with a detection result of the environment sensor 106.

While, in the present example embodiment, by separating the development roller 58 from the photosensitive drum 56, toner is prevented from adhering to the photosensitive drum 56 the configuration is not limited to this, and a state in which the development roller 58 is in contact with the photosensitive drum 56 may be maintained. In this case, for example, by applying voltage with opposite polarity to that in an image formation time as voltage applied from the development power source 500 to the development roller 58, control can be performed in such a manner that toner borne on the development roller 58 is not moved to the photosensitive drum 56.

While, in the present example embodiment, a conductive brush member is used as the primary transfer member 59, the primary transfer member 59 is not limited to this, and a roller member including a conductive elastic layer, a conductive sheet member, or a metal roller can also be used.

While, in the present example embodiment, a configuration that can separate the primary transfer members 59*a* to 59*d* from the intermediate transfer belt 54 has been described, the configuration is not limited to this. For example, a configuration of causing the primary transfer member 59*d* corresponding to the image forming unit 64*d* storing black toner to be always in contact with the intermediate transfer belt 54 may be employed. In other words, a configuration in which the primary transfer member 59*d* and the intermediate transfer belt 54 are always in contact with each other may be employed. In this case, such contact control can be performed by employing an urging configuration for causing only the primary transfer members 59*a* to 59*c* to be in contact with and separated from the intermediate transfer belt 54.

While, in the present example embodiment, a configuration of applying voltage from the common primary transfer power source 200 to all the primary transfer members 59*a* to 59*d* is used, but the configuration is not limited to this, and voltage from a common primary transfer power source may be applied only to a part of the primary transfer members 59. More specifically, by using a common primary transfer power source for applying voltage to at least two primary transfer members, the effects described in the present example embodiment can be obtained.

In the first example embodiment, which state of the first state and the second state is formed is determined based on the comparison between a detection result obtained by the current detection circuit 201 and the predetermined threshold a. In contrast to this, in a second example embodiment, which state of the first state and the second state is formed is determined based on a detection result obtained by the current detection circuit 201 before control of separating the primary transfer member 59 from the intermediate transfer belt 54 is executed, and a detection result obtained by the current detection circuit 201 after the control is executed. In the following description, configurations and controls of the second example embodiment that are similar to those in the first example embodiment are assigned the same reference numerals, and the description will be omitted.

In the case of continuously executing an image forming operation using a new job after a predetermined job is completed, the image forming apparatus 100 identifies which state of the first state and the second state is formed, when starting a new job. Thus, in the present example embodiment, which state of the first state and the second state is formed is determined based on a detection result obtained by the current detection circuit 201 before control of separating the primary transfer member 59 from the intermediate transfer belt 54 is executed, and a detection result obtained by the current detection circuit 201 after the control is executed. Hereinafter, the detailed description will be given with reference to FIG. 8.

[Example Detection of Contact State between Primary Transfer Member and Intermediate Transfer Belt]

Figure 8:
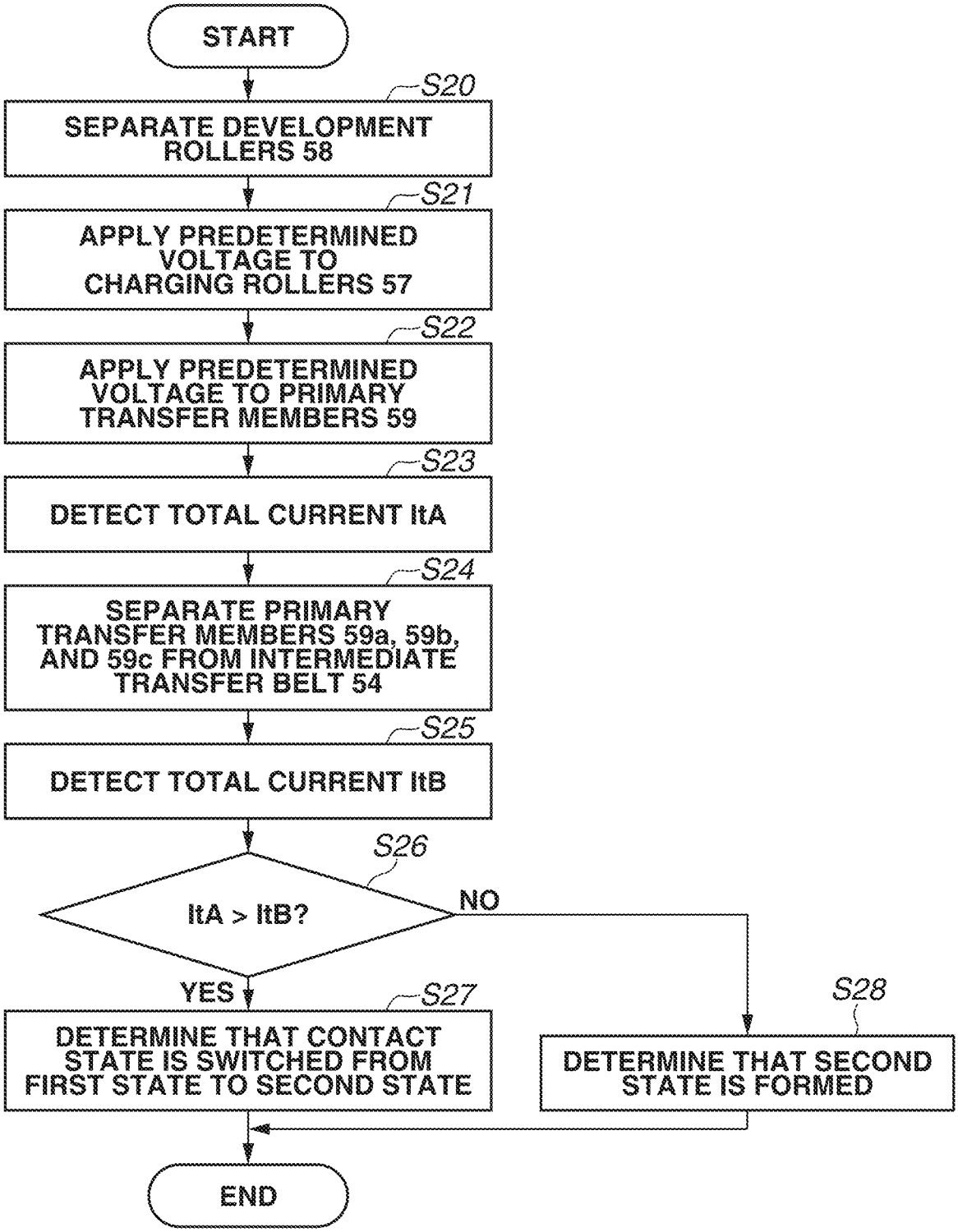
FIG. 8 is a flowchart illustrating a detection method of a contact state between a primary transfer member and an intermediate transfer member according to a second example embodiment.

FIG. 8 is a flowchart illustrating a detection method of a contact state between the primary transfer members 59 and the intermediate transfer belt 54 according to the present example embodiment.

As illustrated in FIG. 8, in the case of detecting a contact state between the primary transfer member 59 and the intermediate transfer belt 54, first of all, in step S20, the development rollers 58 are separated. The surfaces of the photosensitive drums 56 having the surface potential are thereby brought to the positions of the respective primary transfer members 59 without toner adhering to the surfaces. After that, in step S21, predetermined voltage Va is applied from the charging power source 400 to the charging rollers 57*a*, 57*b*, 57*c*, and 57*d*. Then, in step S22, predetermined voltage Vb is applied from the primary transfer power source 200 to the primary transfer members 59. The predetermined voltage Va and the predetermined voltage Vb are determined in accordance with the generated voltage values thereof based on a calculation formula or a lookup table obtained in advance.

After that, in step S23, the current detection circuit 201 detects a total current ItA. In this process, which state of the first state and the second state is formed is not identified. Then, in step S24, the controller 10 executes an operation of separating the primary transfer members 59*a*, 59*b*, and 59*c* from the intermediate transfer belt 54 by controlling an urging unit (not illustrated) urging the primary transfer members 59. After it is determined that the control of separating the primary transfer members 59*a*, 59*b*, and 59*c* from the intermediate transfer belt 54 is executed by the controller 10, in step S25, the current detection circuit 201 detects a total current ItB.

In step S26, the controller 10 compares values of the total current ItA and the total current ItB. In a case where the value of the total current ItA is larger than the value of the total current ItB (YES in step S26), the processing proceeds to step S27. In step S27, the controller 10 determines that the contact state between the primary transfer member 59 and the intermediate transfer belt 54 is switched from the first state to the second state. In other words, the controller 10 determines that the first state in which the primary transfer members 59 are in contact with the intermediate transfer belt 54 is formed at the time point of step S23.

Meanwhile, if the total current ItA is smaller than or equal to the total current ItB (NO in step S26), the processing proceeds to step S28. In step S28, the controller 10 determines that the contact state is a state in which only the primary transfer member 59*d* is in contact with the intermediate transfer belt 54. More specifically, the controller 10 determines in step S28 that the contact state between the primary transfer members 59 and the intermediate transfer belt 54 is the second state in which only the primary transfer member 59*d* is in contact with the intermediate transfer belt 54, from the start of the detection operation. In other words, the controller 10 determines that the second state in which only the primary transfer member 59*d* is in contact with the intermediate transfer belt 54 is formed at the time point of step S23.

As described above, according to the present example embodiment, a contact state between the primary transfer member 59 and the intermediate transfer belt 54 can be determined based on a detection result obtained by the current detection circuit 201 before control of separating the primary transfer member 59 from the intermediate transfer belt 54 is executed, and a detection result obtained by the current detection circuit 201 after the control is executed. As a result, in the present example embodiment, the effects similar to those in the first example embodiment are obtained, and moreover, a contact state between the primary transfer member 59 and the intermediate transfer belt 54 when an image forming operation using a new job is subsequently performed after a predetermined job is completed can be detected.

Furthermore, according to the configuration of the present example embodiment, comparison based on a relative difference in current flowing in the primary transfer member 59, between before and after the separation operation, can be performed. As a result, the effects similar to those in the first example embodiment are obtained, and moreover, determination of a contact state between the primary transfer member 59 and the intermediate transfer belt 54 even under the condition under which impedance of each member varies, such as the conditions illustrated in FIGS. 6E and 6F can be accurately performed.

While, in the present example embodiment, the controller 10 executes the operation of separating the primary transfer members 59*a*, 59*b*, and 59*c* from the intermediate transfer belt 54, and determines a contact state between the primary transfer members 59 and the intermediate transfer belt 54 based on detection results obtained by the current detection circuit 201 before and after the operation, the configuration is not limited to this. A detection result obtained by the current detection circuit 201 in a previous job or the like may be stored in the RAM 152, and a contact state between the primary transfer member 59 and the intermediate transfer belt 54 may be determined by comparing the stored value and a detection result of the current detection circuit 201.

In the first example embodiment, determination of which state of the first state and the second state is formed is performed based on the comparison between the detection result obtained by the current detection circuit 201 and the predetermined threshold a. Meanwhile, in a third example embodiment, the photosensitive drums 56 are sequentially exposed by the exposure units 60, and determination of which state of the first state and the second state is performed based on a detection result obtained by the current detection circuit 201. In the following description, configurations and controls of the third example embodiment that are similar to those in the first example embodiment are assigned the same reference numerals, and the description will be omitted.

[Example Sequential Exposure of Photosensitive Drums Performed by Exposure Unit]

Figure 9A:
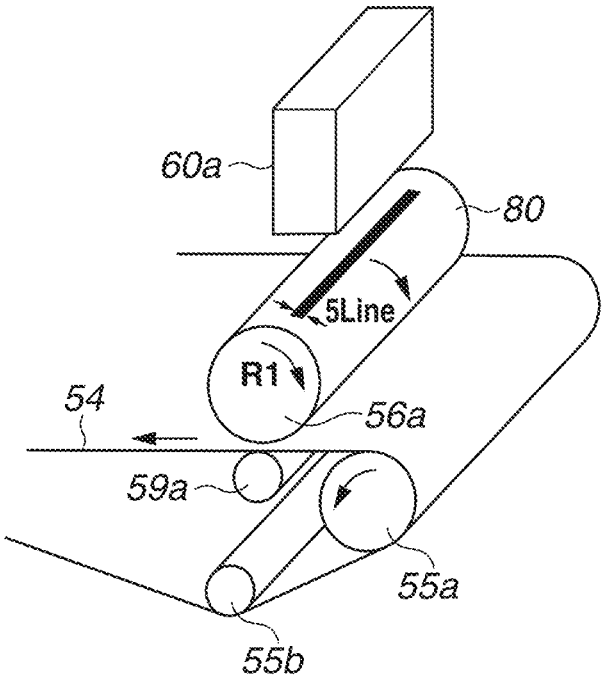
FIGS. 9A, 9B and 9C are schematic diagrams illustrating a surface potential of an image bearing member and a current detected by a detection unit according to a third example embodiment.

FIG. 9A is a schematic diagram illustrating a state in which an electrostatic latent image 80 is formed on the photosensitive drum 56*a* by exposing of the photosensitive drum 56*a* by the exposure unit 60*a*. As illustrated in FIG. 9A, the electrostatic latent image 80 is formed to be widest as long as possible relative to the width of an image formation region being a region in which the photosensitive drum 56*a* can bear a toner image, with respect to a scanning direction of the exposure unit 60*a*. The electrostatic latent image 80 is formed to have a width corresponding to about five lines with respect to the arrow R1 direction illustrated in FIG. 9, which is a rotational direction of the photosensitive drum 56*a*. It is desirable that the electrostatic latent image 80 is formed to have a width in a main scanning direction of a half width or more of the largest width of the image formation region, for obtaining a more desirable detection result by the current detection circuit 201.

Figure 9B:
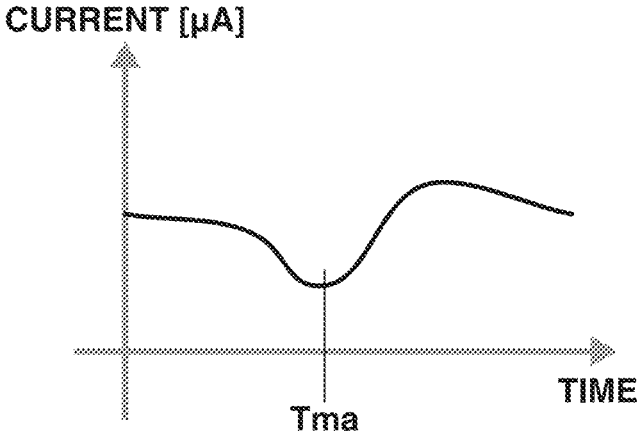

FIG. 9B illustrates a graph indicating a detection result obtained by the current detection circuit 201 when the electrostatic latent image 80 reaches the primary transfer portion N1*a*. In FIG. 9B, a vertical axis indicates a value of a current detected by the current detection circuit 201, and a horizontal axis indicates an elapsed time. As illustrated in FIG. 9B, a value of a current detected by the current detection circuit 201 becomes minimum at a time point Tma by the electrostatic latent image 80 reaching the primary transfer portion N1*a*, and then, the current value becomes larger after the electrostatic latent image 80 passes through the primary transfer portion N1*a*.

Figure 9C:
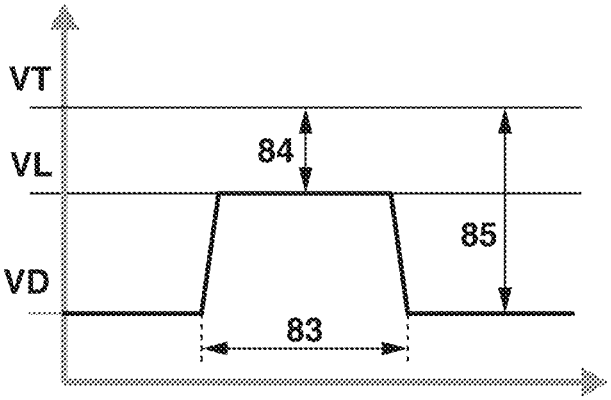

The reason why the value of the current detected by the current detection circuit 201 decreases at the time point Tma will be described. FIG. 9C is a schematic diagram illustrating a surface potential of the photosensitive drum 56*a*. In FIG. 9C, a horizontal axis indicates a surface position with respect to a rotational direction of the photosensitive drum 56*a*, and a vertical axis indicates a potential. A region 83 indicates a position in which the electrostatic latent image 80 is formed. A potential VD is a potential at a position on the surface of the photosensitive drum 56*a* that is not exposed by the exposure unit 60*a*, and a potential VL is a potential at a position on the surface of the photosensitive drum 56*a* that is exposed by the exposure unit 60*a*. A potential VT indicates a value of voltage applied from the primary transfer power source 200 to the primary transfer member 59*a* for detecting the contact state of the primary transfer member 59*a* in the present example embodiment.

As illustrated in FIG. 9C, in the region 83 of the electrostatic latent image 80, a potential difference 84 between the primary transfer member 59*a* and the photosensitive drum 56*a* becomes smaller than a potential difference 85 in other regions. Thus, if the electrostatic latent image 80 reaches the primary transfer portion N1*a*, the value of the current flowing in the primary transfer member 59*a* decreases. Then, by the detection result obtained by the current detection circuit 201 accordingly decreasing, the value of the current detected by the current detection circuit 201 becomes minimum at the time point Tma as illustrated in FIG. 9B. In this manner, the value of the current detected by the current detection circuit 201 reflects the surface potential of the photosensitive drum 56*a*.

[Example Detection of Contact State between Primary Transfer Member and Intermediate Transfer Belt]

Figure 10:
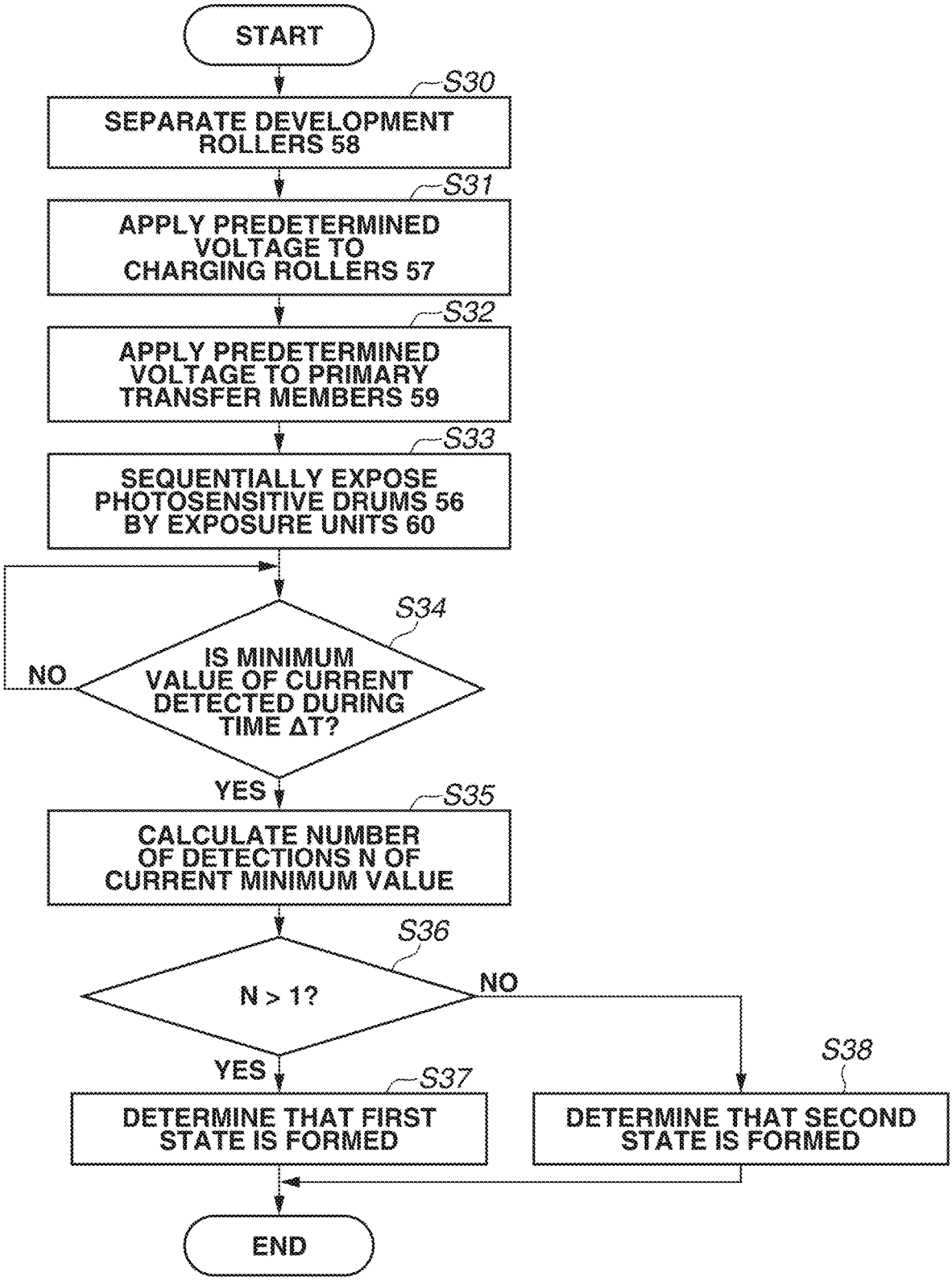
FIG. 10 is a flowchart illustrating a detection method of a contact state between a primary transfer member and an intermediate transfer member according to the third example embodiment.
Figure 11A:
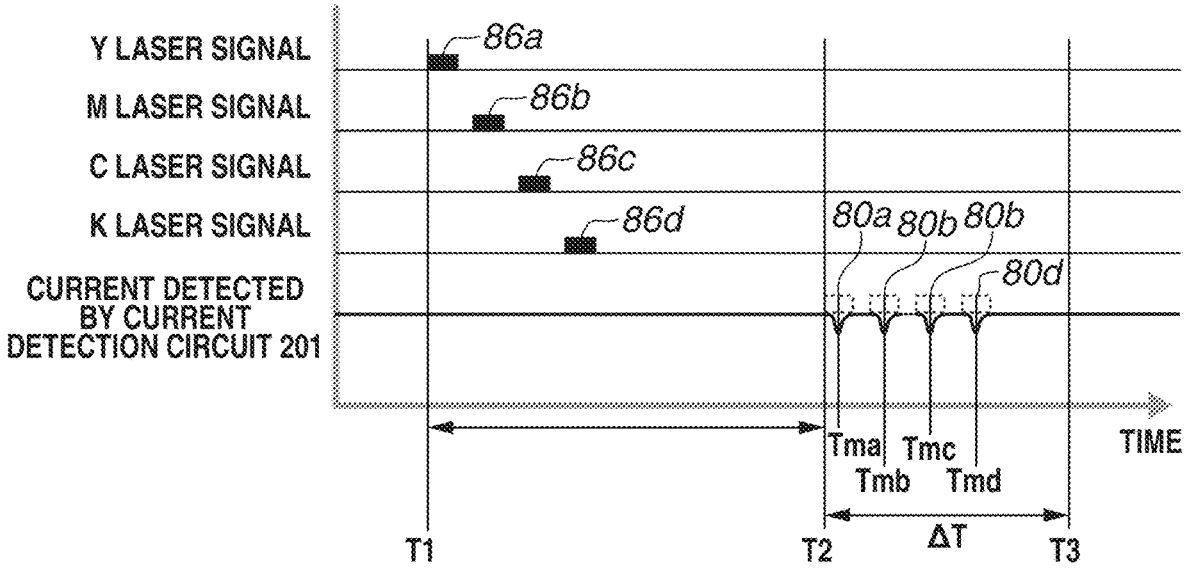
FIGS. 11A and 11B are time charts each illustrating a current detected by the detection unit in each mode according to the third example embodiment.
Figure 11B:
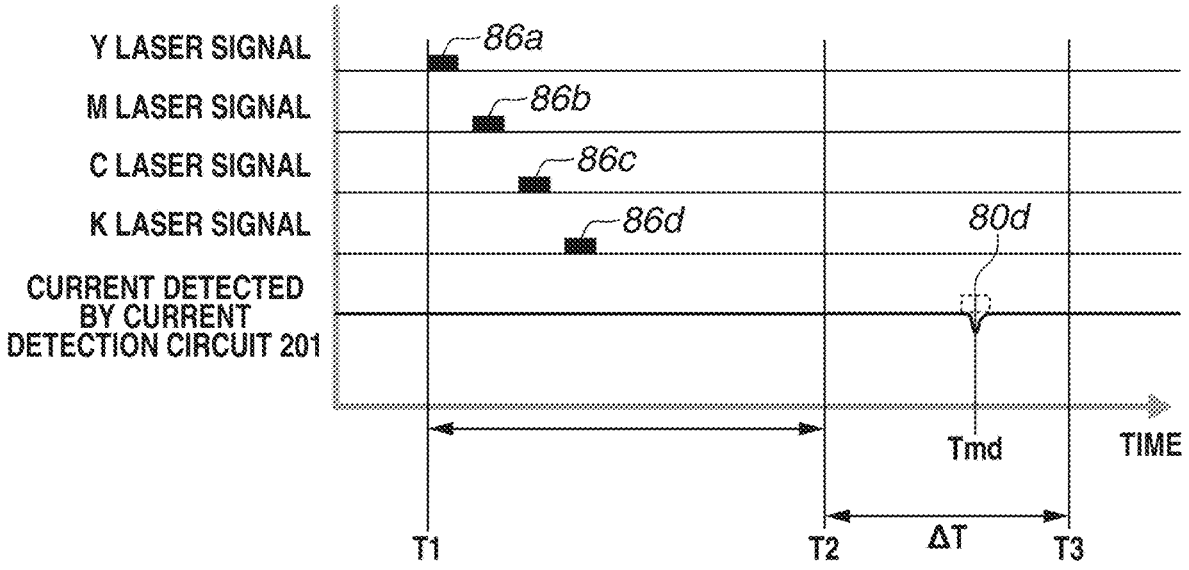

FIG. 10 is a flowchart illustrating a detection method of a contact state between the primary transfer members 59 and the intermediate transfer belt 54 according to the present example embodiment. FIG. 11A is a schematic diagram illustrating a current detected by the current detection circuit 201 in the first state in which all the primary transfer members 59*a* to 59*d* are in contact with the intermediate transfer belt 54. FIG. 11B is a schematic diagram illustrating a current detected by the current detection circuit 201 in the second state in which the primary transfer members 59*a* to 59*c* are separated from the intermediate transfer belt 54 and only the primary transfer member 59*d* is in contact with the intermediate transfer belt 54.

As illustrated in FIG. 10, in the case of detecting a contact state between the primary transfer member 59 and the intermediate transfer belt 54, first of all, in step S30, the development rollers 58 are separated. The surfaces of the photosensitive drums 56 having the surface potential are thereby brought to the positions of the respective primary transfer members 59 without toner adhering to the surfaces. After that, in step S31, predetermined voltage Va is applied from the charging power source 400 to the charging rollers 57*a*, 57*b*, 57*c*, and 57*d*. Then, in step S32, predetermined voltage Vb is applied from the primary transfer power source 200 to the primary transfer members 59. The predetermined voltage Va and the predetermined voltage Vb are determined in accordance with the generated voltage values thereof based on a calculation formula or a lookup table obtained in advance.

In step S33, the controller 10 controls the exposure control unit 101 to sequentially output four signals including laser signals 86*a* to 86*d* to the respective exposure units 60*a* to 60*d* at the timing of a time point Ti illustrated in FIGS. 11A to 11B. Then, based on the output laser signals 86*a* to 86*d*, the exposure units 60*a* to 60*d* emit light onto the photosensitive drums 56*a* to 56*d*, and form electrostatic latent images 80*a* to 80*d* corresponding to the laser signals 86*a* to 86*d* on the respective photosensitive drums 56*a* to 56*d*. The electrostatic latent images 80*b* to 80*d* are substantially the same as the electrostatic latent image 80*a* already described with reference to FIGS. 9A to 9C, except that the photosensitive drums on which the electrostatic latent images are formed are different.

In FIGS. 11A and 11B, a time from the time point Ti to a time point T2 is a time for the photosensitive drum 56*a* rotationally moving by a distance from a position at which light emission from the exposure unit 60*a* onto the photosensitive drum 56*a* is started, to the primary transfer portion N1*a*. At the time point T2, as described above with reference to FIG. 9B, a current minimum value corresponding to each of the electrostatic latent images 80*a* to 80*d* is detected by the current detection circuit 201. More specifically, if the first state in which the primary transfer members 59*a* to 59*d* are in contact with the intermediate transfer belt 54 is formed, as illustrated in FIG. 11A, during a time from the time point Tma to a time point Tmd, a current minimum value is detected four times so as to correspond to the respective electrostatic latent images 80*a* to 80*d*. Meanwhile, if the second state in which only the primary transfer member 59*d* is in contact with the intermediate transfer belt 54 is formed, as illustrated in FIG. 11B, at the time point Tmd, a current minimum value is detected only once so as to correspond to the electrostatic latent image 80*d*.

In view of the foregoing, in the present example embodiment, in step S34 illustrated in FIG. 10, the controller 10 determines whether the current detection circuit 201 detects the current minimum value during a time ΔT serving as a predetermined detection time. The time ΔT corresponds to a section between the time point T2 and a time point T3 that is illustrated in FIGS. 11A and 11B. More specifically, the time ΔT at least includes a time from a time point at which a leading end position in the rotational direction of the electrostatic latent image 80*a* formed on the photosensitive drum 56*a* reaches the primary transfer portion N1*a*, to a time point at which the electrostatic latent image 80*d* formed on the photosensitive drum 56*d* finishes passing through the primary transfer portion N1*d*.

In step S35, the number of detections N is calculated by counting the number of times the current minimum value is detected during the time ΔT, and in step S36, the controller 10 determines whether the number of detections N is larger than 1. In a case where the counted number of times N is a value larger than 1 (YES in step S36), the processing proceeds to step S37. In step S37, the controller 10 determines that the primary transfer members 59 are in contact with the intermediate transfer belt 54. In a case where the number of detections N is larger than 1 (YES in step S36), the controller 10 determines in step S37 that the contact state is the first state in which the primary transfer members 59 and the intermediate transfer belt 54 are in contact with each other. Meanwhile, in a case where the number of detections N is smaller than or equal to 1 (NO in step S36), the processing proceeds to step S38. In step S38, the controller 10 determines that the contact state is a state in which only the primary transfer member 59*d* is in contact with the intermediate transfer belt 54. More specifically, in step S38, the controller 10 determines that the contact state is the second state in which the primary transfer member 59*d* and the intermediate transfer belt 54 are in contact with each other, and the primary transfer members 59*a* to 59*c* are separated from the intermediate transfer belt 54.

While, in the present example embodiment, the case of determining which state of the first state and the second state is formed has been described, detection of a third state in which all the primary transfer members 59 are separated from the intermediate transfer belt 54, for example, can be performed in the configuration of the present example embodiment. More specifically, for example, if it is determined in step S36 that the number of detections N is smaller than or equal to 1 (NO in step S36), another sequence is further set. In the sequence, determination of whether the number of detections N is 1 or 0 is performed. Then, the controller 10 is only required to determine that the contact state is the second state in which only the primary transfer member 59*d* is in contact with the intermediate transfer belt 54, if the number of detections N is 1, and determine that the contact state is the third state in which all the primary transfer members 59 are separated from the intermediate transfer belt 54, if the number of detections N is 0.

As described above, according to the present example embodiment, the photosensitive drums 56 are sequentially exposed by the respective exposure units 60, and determination of which state of the first state and the second state is formed is performed based on a detection result obtained by the current detection circuit 201. With this configuration, the effects similar to those in the first example embodiment are obtained, and moreover, determination of a contact state between the primary transfer member 59 and the intermediate transfer belt 54 can be accurately performed independently of the accuracy of current detection performed by the current detection circuit 201.

While, in the present example embodiment, the electrostatic latent image 80 is formed once in total with respect to the rotation corresponding to a single lap of the photosensitive drum 56, the number of times the electrostatic latent image 80 is formed is not limited to this. The number of times the electrostatic latent image 80 is formed may be one or more, and the number of times the electrostatic latent image 80 is formed may be varied depending on each of the photosensitive drums 56. By controlling the number of times in this manner, determination of which of the primary transfer members 59 is in contact with the intermediate transfer belt 54 can be accurately performed.

In the first to third example embodiments, determination of which state of the first state and the second state is formed is performed based on a detection result obtained by the current detection circuit 201. Meanwhile, in a fourth example embodiment, determination of which state of the first state and the second state is formed is performed based on a detection result obtained by the current detection circuit 201, and a detection result of a test image formed on the intermediate transfer belt 54. In the following description, configurations and controls of the fourth example embodiment that are similar to those in the first to third example embodiments are assigned the same reference numerals, and the description will be omitted.

[Example Detection of Test Image]

Figure 12:
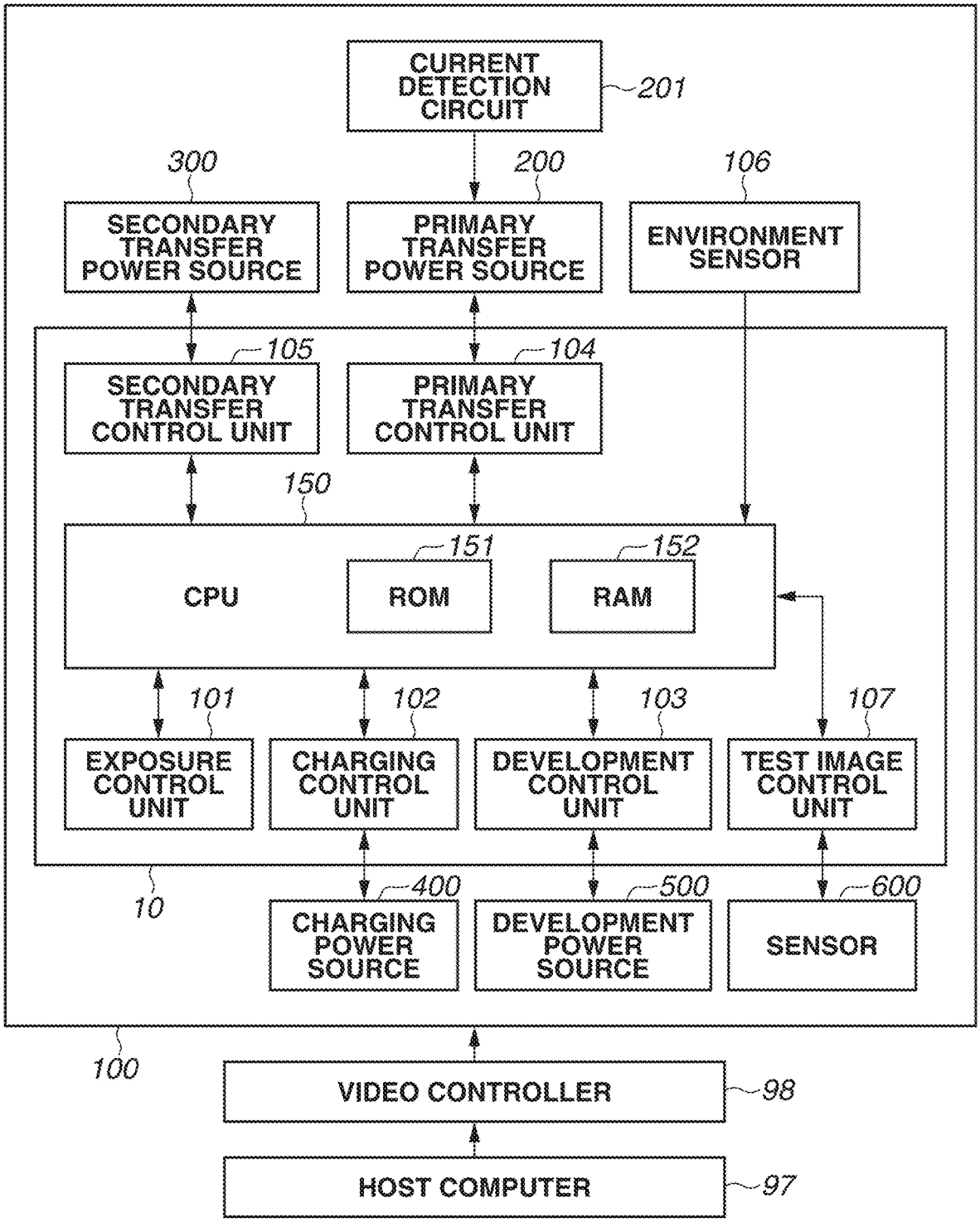
FIG. 12 is a block diagram illustrating a controller related to image formation according to a fourth example embodiment.

FIG. 12 is a block diagram of a control system of an image forming apparatus 100 according to the present example embodiment. In FIG. 12, the test image control unit 107 can detect a test image formed from the photosensitive drum 56 onto the intermediate transfer belt 54, in cooperation with a sensor 600 serving as a test image detection unit. The test image is an image formed from the photosensitive drum 56 onto the intermediate transfer belt 54 at a timing at which image formation is not performed (hereinafter, will be referred to as a non-image formation time), for controlling the position and the density of a toner image in an image formation time, for example.

The sensor 600 is a specular reflectance optical system including a light-emitting diode (LED) light emitting element (not illustrated) and a light receiving element (not illustrated), and information detected by the sensor 600 is transmitted to the test image control unit 107. The CPU 150 can process detection data from the test image control unit 107, and calculate a color shift amount and a correction amount of a toner image to be formed in a next image formation time. In the present example embodiment, if it is determined that a predetermined test image is not detected by the sensor 600, the controller 10 can determine that the second state in which only the primary transfer member 59*d* is in contact with the intermediate transfer belt 54 is formed. Hereinafter, the detailed description will be given with reference to FIG. 13.

[Example Detection of Contact State between Primary Transfer Member and Intermediate Transfer Belt]

Figure 13:
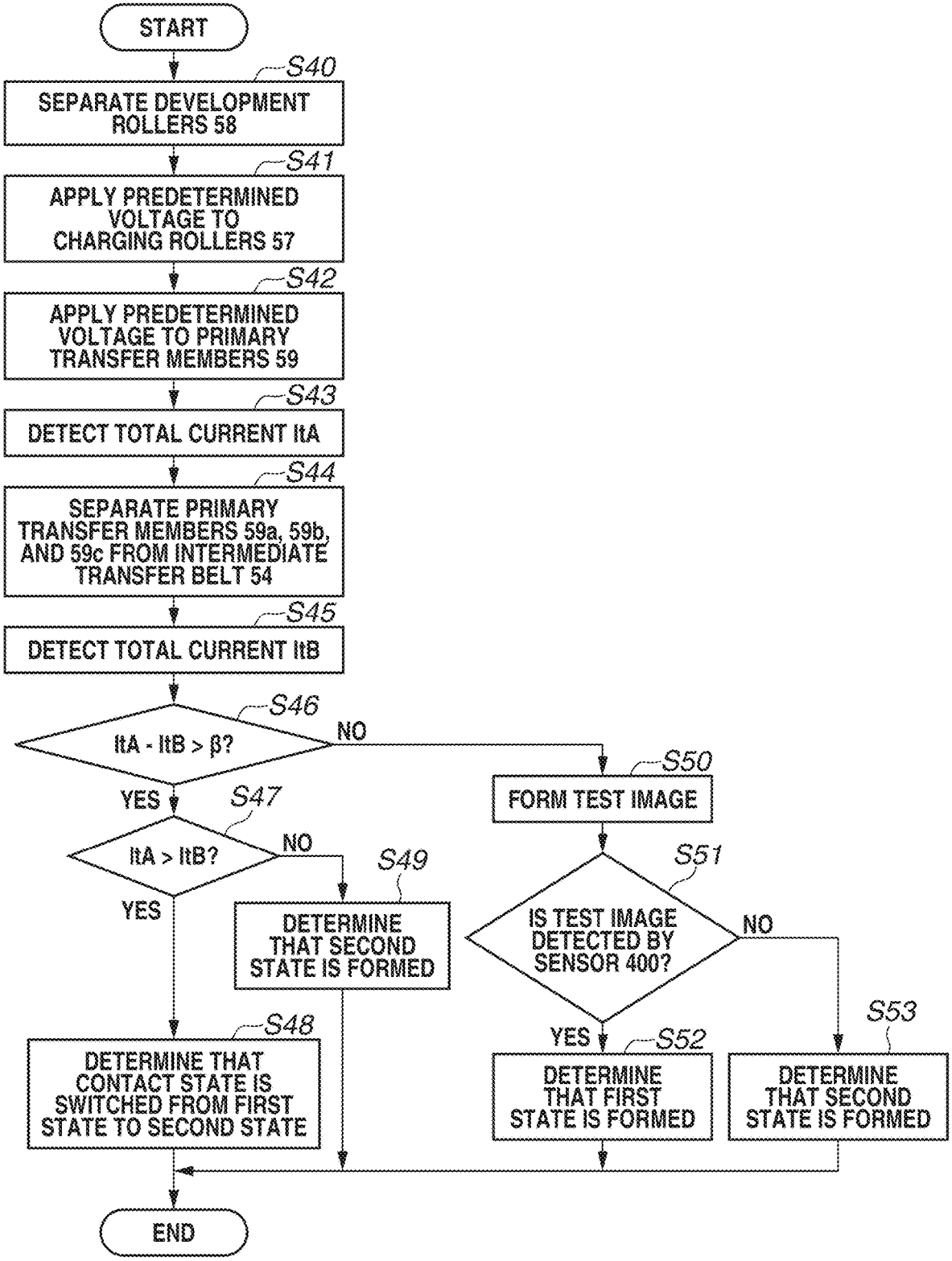
FIG. 13 is a flowchart illustrating a detection method of a contact state between a primary transfer member and an intermediate transfer member according to the fourth example embodiment.

FIG. 13 is a flowchart illustrating a detection method of a contact state between the primary transfer members 59 and the intermediate transfer belt 54 according to the present example embodiment. In the present example embodiment, contact/separation of the primary transfer members 59 and the intermediate transfer belt 54 is determined based on a detection result obtained by the current detection circuit 201, and a detection result of a test image formed on the intermediate transfer belt 54.

As illustrated in FIG. 13, in the case of detecting a contact state between the primary transfer member 59 and the intermediate transfer belt 54, first of all, in step S40, the development rollers 58 are separated. The surfaces of the photosensitive drums 56 having the surface potential are thereby brought to the positions of the respective primary transfer members 59 without toner adhering to the surfaces. After that, in step S41, predetermined voltage Va is applied from the charging power source 400 to the charging rollers 57*a*, 57*b*, 57*c*, and 57*d*. Then, in step S42, predetermined voltage Vb is applied from the primary transfer power source 200 to the primary transfer members 59. The predetermined voltage Va and the predetermined voltage Vb are determined in accordance with the generated voltage values thereof based on a calculation formula or a lookup table obtained in advance.

In step S43, the current detection circuit 201 detects the total current ItA. Then, in step S44, the controller 10 executes an operation of separating the primary transfer members 59*a*, 59*b*, and 59*c* from the intermediate transfer belt 54 by controlling an urging unit (not illustrated) urging the primary transfer members 59. After it is determined that the control of separating the primary transfer members 59*a*, 59*b*, and 59*c* from the intermediate transfer belt 54 is executed by the controller 10, in step S45, the current detection circuit 201 detects the total current ItB. In step S46, the controller 10 compares a value of difference between the total current ItA and the total current ItB with the value of the threshold β. The details of the threshold β will be described below.

In a case where it is determined in step S46 that the value of difference between the total current ItA and the total current ItB is a value larger than the threshold β (YES in step S46), the processing proceeds to step S47. In step S47, the controller 10 compares the values of the total current ItA and the total current ItB. In a case where the value of the total current ItA is larger than the value of the total current ItB (YES in step S47), the processing proceeds to step S48. In step S48, the controller 10 determines that a contact state between the primary transfer members 59 and the intermediate transfer belt 54 is switched from the first state to the second state. In other words, the controller 10 determines that the first state in which the primary transfer members 59 are in contact with the intermediate transfer belt 54 is formed at the time point of step S43.

Meanwhile, in a case where the value of the total current ItA is smaller than or equal to the value of the total current ItB (NO in step S47), the processing proceeds to step S49. In step S49, the controller 10 determines that the contact state is the second state in which only the primary transfer member 59*d* is in contact with the intermediate transfer belt 54. In other words, in step S49, the controller 10 determines that the contact state between the primary transfer members 59 and the intermediate transfer belt 54 is the second state in which only the primary transfer member 59*d* is in contact with the intermediate transfer belt 54, from the start of the detection operation.

In a case where it is determined in step S46 that the value of difference between the total current ItA and the total current ItB is smaller than or equal to the threshold JR (NO in step S46), the processing proceeds to step S50. In step S50, the controller 10 controls the test image control unit 107 to form a test image on the intermediate transfer belt 54 using all the photosensitive drums 56 including the photosensitive drums 56*a* to 56*d*. In step S51, the controller 10 determines whether the sensor 600 detects an expected test image. In a case where the sensor 600 detects an expected test image (YES in step S51), the processing proceeds to step S52. In step S52, the controller 10 determines that the contact state is the first state in which the primary transfer members 59 are in contact with the intermediate transfer belt 54. Meanwhile, in a case where the sensor 600 does not detect an expected test image (NO in step S51), the processing proceeds to step S53. In step S53, the controller 10 determines that the contact state is the second state in which only the primary transfer member 59*d* is in contact with the intermediate transfer belt 54.

The case where the sensor 600) does not detect an expected test image even though a test image is formed using all the photosensitive drums 56 will now be supplementary described. In this case, because a toner image on any of the photosensitive drums 56 fails to be transferred onto the intermediate transfer belt 54 by any of the primary transfer members 59 not being in contact with the intermediate transfer belt 54, the sensor 600 does not detect an expected test image. In the present example embodiment, because the image forming apparatus has the first state and the second state, if an expected test image is not detected, it is possible to determine that the contact state is the second state in which only the primary transfer member 59*d* is in contact with the intermediate transfer belt 54.

While, in the present example embodiment, a test image is formed using all the photosensitive drums 56, the configuration is not limited to this. For example, a test image may be formed using only the photosensitive drums 56*a* to 56*c*. In this case, based on the of an unexpected test image, it is possible to determine that the primary transfer members 59*a* to 59*c* are separated from the intermediate transfer member. Furthermore, by setting conditions of a test image in more detail and incorporating the conditions into a detection sequence of the present example embodiment, detection of which of the primary transfer members 59*a* to 59*d* is in contact with the intermediate transfer belt 54 can be performed more accurately. It is desirable that the settings of a test image are appropriately set based on information desired to be detected.

Next, the threshold β will be described. The threshold β is a threshold to be compared with a value of difference between the total current ItA and the total current ItB that are detected by the current detection circuit 201, and is stored in the ROM 151 (illustrated in FIG. 12). The value of the threshold β is to be determined considering a value variation range of the total current It (the total current ItA and the total current ItB in the present example embodiment) that has been described with reference to FIGS. 6A-6F, in addition to the predetermined voltage Va applied to the charging rollers 57 and the predetermined voltage Vb applied to the primary transfer members 59.

In the present example embodiment, the predetermined voltage Va applied to the charging rollers 57 is determined in such a manner that the surface potential of the photosensitive drum 56 becomes at least −400 [V] or more, and the predetermined voltage Vb is determined in such a manner that a current flowing in the primary transfer members 59 becomes 5 [μA] or more. Then, a value of the threshold 1 is set to 3 [A] considering these conditions.

As described above, in the present example embodiment, a contact state between the primary transfer member 59 and the intermediate transfer belt 54 is determined based on a detection result obtained by the current detection circuit 201, and a detection result of a test image formed on the intermediate transfer belt 54. With this configuration, the effects similar to those in the first and second example embodiments are obtained, and moreover, even if a detection result of the current detection circuit 201 varies due to an external factor, determination of the contact state of the primary transfer members 59 with respect to the intermediate transfer belt 54 can be accurately performed.

Figure 14:
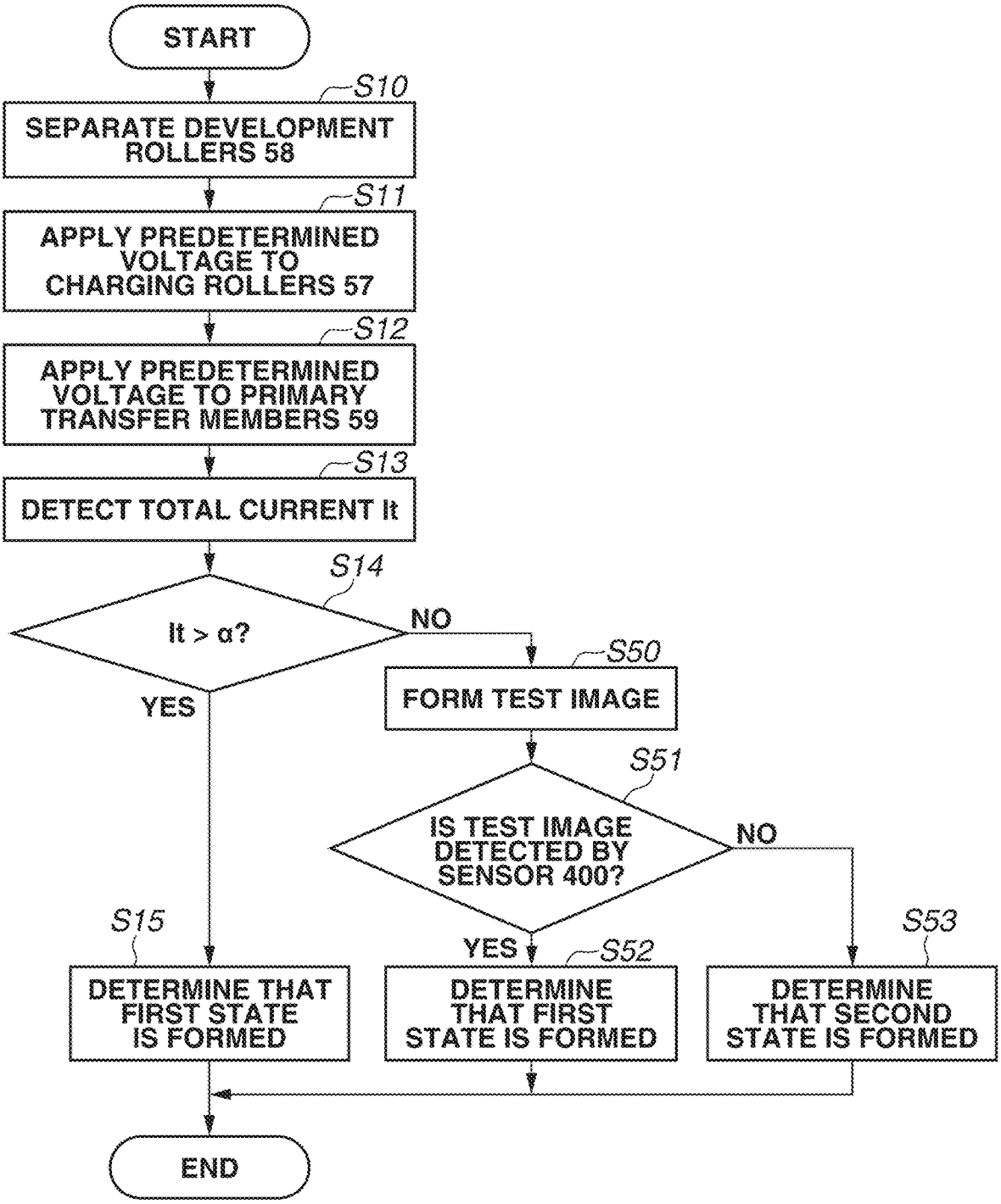
FIG. 14 is a flowchart illustrating a detection method of a contact state between a primary transfer member and an intermediate transfer member according to a modified example of the fourth example embodiment.

While, in the present example embodiment, the contact state of the primary transfer member 59 is determined based on a detection result of a test image, and a detection result obtained by the current detection circuit 201 before control of separating the primary transfer member 59 from the intermediate transfer belt 54 is executed, and a detection result obtained by the current detection circuit 201 after the control is executed, the configuration is not limited to this. Alternatively, in the configurations described in the first to third example embodiments, similarly to the present example embodiment, by using the detection that is based on a test image in combination, determination of a contact state of the primary transfer member 59 can be performed more accurately. For example, as illustrated in FIG. 14 illustrating a modified example of the present example embodiment, determination of which state of the first state and the second state is formed may be performed based on a current detection result in the first example embodiment and a detection result of a test image.

The configuration of a fifth example embodiment will be described with reference to FIGS. 15 to 19. In the description of the present example embodiment, parts similar to those in the first example embodiment are assigned the same reference numerals, and the description will be omitted.

Figure 15:
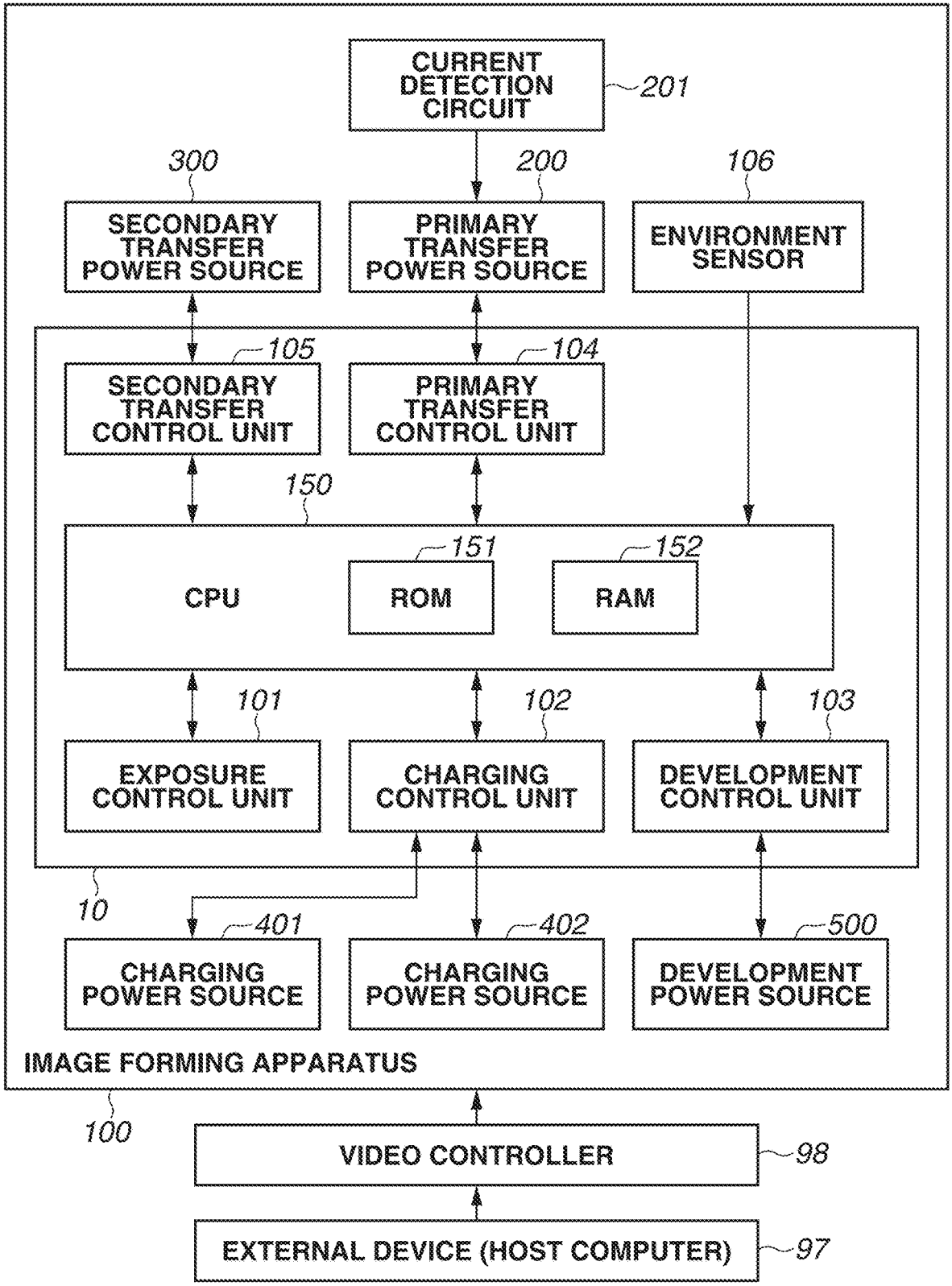
FIG. 15 is a block diagram illustrating control related to image formation according to a fifth example embodiment.

FIG. 15 is a block diagram illustrating a control system of an image forming apparatus 100 according to the present example embodiment. As illustrated in FIG. 15, in the configuration of the present example embodiment, a charging power source 401 is connected with the charging rollers 57*a* to 57*c*, and a charging power source 402 is connected with the charging roller 57*d*. More specifically, by applying predetermined voltage from the charging power source 401 to the charging rollers 57*a* to 57*c*, the surfaces of the photosensitive drums 56*a* to 56*c* are uniformly charged by the charging rollers 57*a* to 57*c* to a predetermined potential. By applying predetermined voltage from the charging power source 402 to the charging roller 57*d*, the surface of the photosensitive drum 56*d* is uniformly charged by the charging roller 57*d* to a predetermined potential.

In the present example embodiment, the photosensitive drum 56 is charged by the charging roller 57 to negative polarity. While, in the present example embodiment, the description has been given of a contact charging method of charging the photosensitive drum 56 in a state in which the charging roller 57 is in contact with the photosensitive drum 56, the charging method is not limited to this. Alternatively, a noncontact charging method such as a corona charging method may be used as a method of charging the photosensitive drum 56.

While, in the present example embodiment, the description has been given of a configuration of applying voltage to the charging rollers 57*a* to 57*c* from the charging power source 401, and applying voltage to the charging roller 57*d* from the charging power source 402, the configuration is not limited to this. Charging power sources may be individually provided for the respective charging rollers 57*a* to 57*d*, or a common charging power source may be provided for any two of the charging rollers 57*a* to 57*c*.

[Pathway of Current Flowing in Primary Transfer Portion]

Figure 16A:
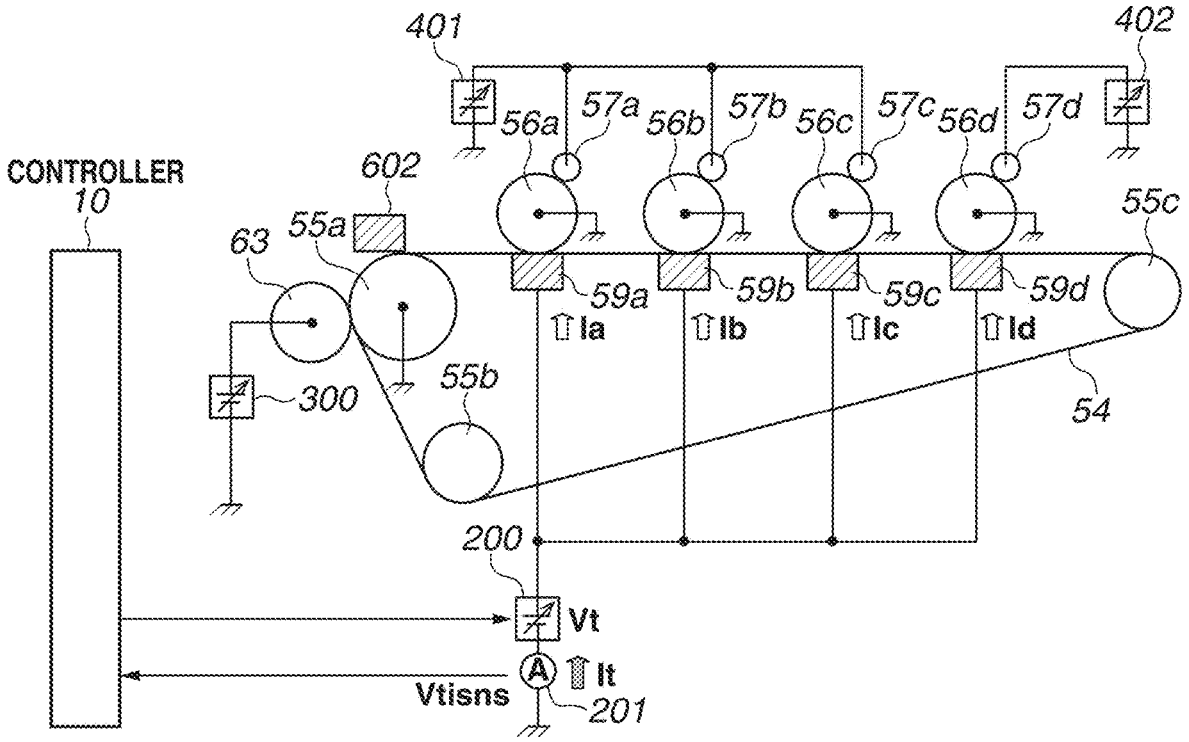
FIGS. 16A and 16B are schematic diagrams illustrating a current flowing in a primary transfer member in a full color mode according to the fifth example embodiment.
Figure 16B:
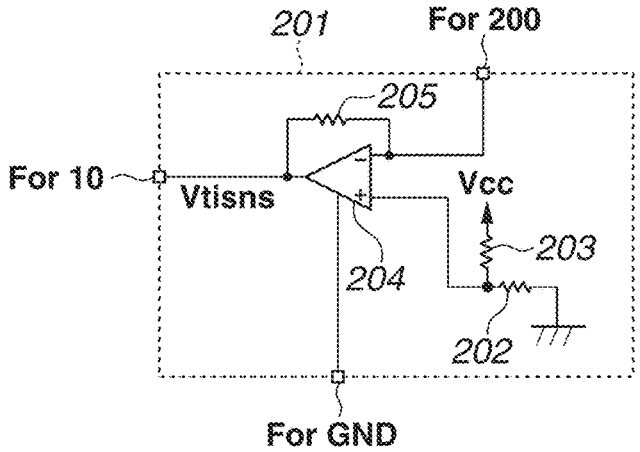
Figure 17:
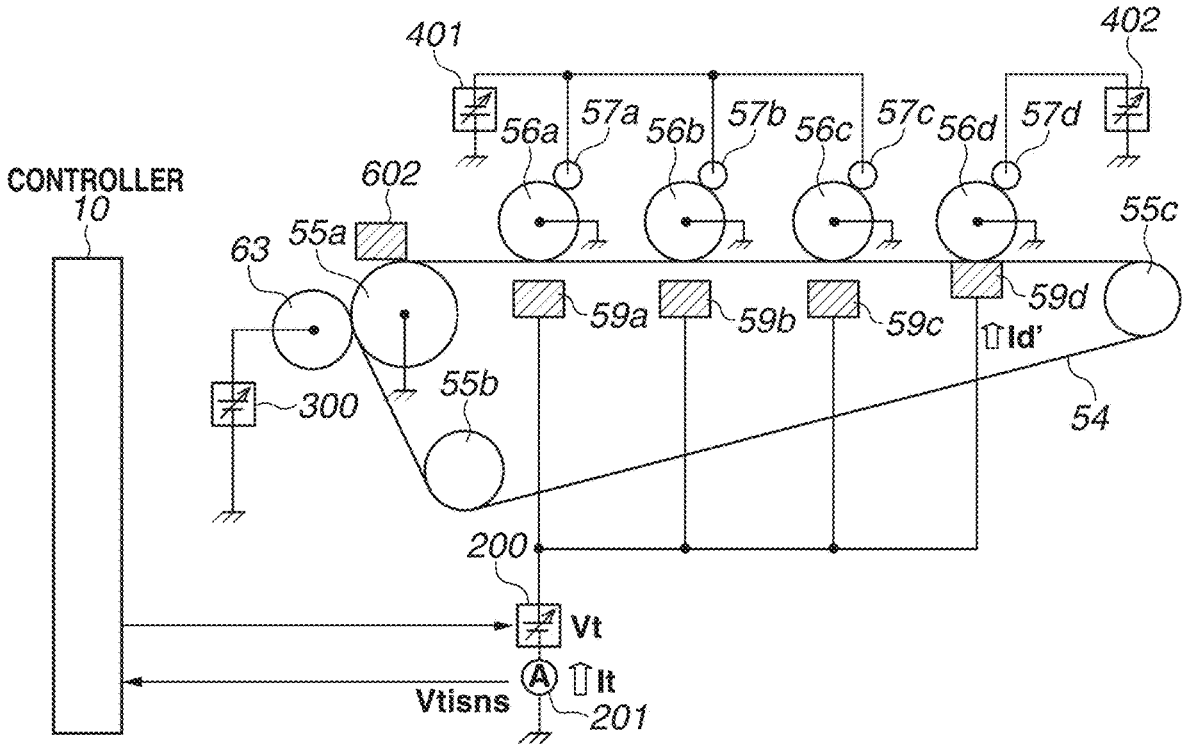
FIG. 17 is a schematic diagram illustrating a current flowing in a primary transfer member in a monochrome mode according to the fifth example embodiment.

Next, a pathway of a current flowing in the primary transfer portion N1 in the full color mode and the monochrome mode will be described with reference to FIGS. 16A to 16B and 17. FIG. 16A is a schematic diagram illustrating a pathway of a current flowing in the primary transfer portion N1 in the full color mode, and FIG. 16B is a schematic diagram illustrating the current detection circuit 201. FIG. 17 is a schematic diagram illustrating a pathway of a current flowing in the primary transfer portion N1 in the monochrome mode. The characteristics of the present example embodiment lie in that voltage is supplied from the common primary transfer power source 200 to the plurality of primary transfer members 59, and a primary transfer current flowing in each of the primary transfer portions N1 is detected by the common current detection circuit 201 (detection unit).

As illustrated in FIG. 16A to 16B, in the present example embodiment, the charging power source 401 is connected with the charging rollers 57*a* to 57*c* and the charging power source 402 is connected with the charging roller 57*d*. More specifically, by applying predetermined voltage from the charging power source 401 to the charging rollers 57*a* to 57*c*, the surfaces of the photosensitive drums 56*a* to 56*c* are uniformly charged by the charging rollers 57*a* to 57*c* to a predetermined potential. By applying predetermined voltage from the charging power source 402 to the charging roller 57*d*, the surface of the photosensitive drum 56*d* is uniformly charged by the charging roller 57*d* to a predetermined potential.

<Full Color Mode>

By the ATVC control executed in the pre-rotation process of a job, the controller 10 sets a value of primary transfer voltage to be applied from the primary transfer power source 200 to the primary transfer members 59*a*, 59*b*, 59*c*, and 59*d* in the primary transfer of the job. In the following description, in the case of performing the same control on the primary transfer members 59*a*, 59*b*, 59*c*, and 59*d*, alphabetical letters "a" to "d" for distinguishing between the primary transfer members 59*a* to 59*d* corresponding to the respective image forming units 64*a* to 64*d* will be omitted, and the primary transfer members 59*a* to 59*d* will be simply referred to as the primary transfer members 59.

In the ATVC control, first of all, voltage having been subjected to constant current control using a predetermined current value (target current value) is applied from the primary transfer power source 200 to the primary transfer members 59. In this process, the current detection circuit 201 obtains a total value of currents flowing toward the primary transfer portions N1, i.e., a total value of currents flowing in the primary transfer members 59. Based on the detection result of the current detection circuit 201, the controller 10 obtains a value of voltage applied from the primary transfer power source 200 to the primary transfer members 59, and then, sets a value of primary transfer voltage based on the voltage value.

The current detection circuit 201 will now be described with reference to FIG. 16B. The current detection circuit 201 is electrically connected between the primary transfer power source 200 and a ground. The current detection circuit 201 includes an operational amplifier 204 and resistors 202, 203, and 205 that are connected to the primary transfer power source 200, and feeds back an output of the operational amplifier 204 to the controller 10. Voltage obtained by dividing power source voltage Vcc by the resistors 202 and 203 (hereinafter, the voltage will be referred to as voltage Vt) is input to a positive polarity input of the operational amplifier 204. A voltage value of the voltage Vt is set to about several voltages considering the rating of the operational amplifier 204. Because the operational amplifier 204 forms a negative feedback circuit using the resistor 205, a potential difference between a positive polarity input and a negative polarity input of the operational amplifier 204 becomes 0 V. In other words, the positive polarity input and the negative polarity input of the operational amplifier 204 have the same potential as the voltage Vt.

If an output of the primary transfer power source 200 is turned on, voltage is applied to the primary transfer members 59, and as illustrated in FIG. 16A, currents Ia, Ib, Ic, and Id respectively flow in the primary transfer members 59*a*, 59*b*, 59*c*, and 59*d*. The current Ia is a current flowing to the ground (GND) via the primary transfer member 59*a* and the photosensitive drum 56*a*. Similarly to the current Ia, the currents Ib to Id are currents flowing to the GND via the respective primary transfer members 59*b* to 59*d* and the respective photosensitive drums 56*b* to 56*d*. A total value of the currents Ia to Id flowing in the respective primary transfer members 59 is described as a total current It, and the total current It flows from the GND to the operational amplifier 204. The total current It returns from an output terminal of the operational amplifier 204 to the primary transfer power source 200 via the resistor 205. By the current pathway described above, voltage is generated at both ends of the resistor 205, and an output of the operational amplifier 204 (hereinafter, the voltage will be referred to as voltage Visns) becomes a voltage value represented by the following formula 1.

$$Vtisns = Vt + R205 \times It \quad (1)$$

In the formula, R205 denotes a resistance value of the resistor 205. Formula 1 representing information associating the voltage value of the voltage Vtisns and the total current It indicating a total value of currents flowing in the primary transfer members 59 is prestored in the ROM 151 of the controller 10. Based on Formula 1 and the voltage Vtisns output from the current detection circuit 201, the controller 10 can detect, as the total current It, values of currents flowing in the respective primary transfer members 59.

Then, a value of primary transfer voltage is set based on a value (generated voltage value) of the voltage generated at both ends of the resistor 205, and the set primary transfer voltage is output from the primary transfer power source 200 to the primary transfer members 59 when the toner images are primarily transferred from the photosensitive drums 56 onto the intermediate transfer belt 54. In the present example embodiment, when primary transfer is performed, constant voltage control of applying predetermined primary transfer voltage set using the above-described method, from the primary transfer power source 200 to the primary transfer members 59 is executed.

The value of primary transfer voltage set in the ATVC control may be a generated voltage value itself in the ATVC control, or may be determined in accordance with the generated voltage value thereof based on a calculation formula or a lookup table (LUT) obtained in advance. In the present example embodiment, the primary transfer voltage is controlled by the controller 10 based on a detection signal (voltage signal) from the current detection circuit 201 for each condition such as process speed or environment referring to process speed information or environment information. In other words, in the present example embodiment, the above-described plurality of target current values is set in accordance with a condition such as process speed or environment. An execution timing of the ATVC control is not limited to the time of the pre-rotation process which is until the time when image formation of the job is started, and the ATVC control can be executed at an arbitrary timing as long as image formation is not performed.

<Example Monochrome Mode>

Similarly to the above-described full color mode, by the ATVC control executed in the pre-rotation process of a job, the controller 10 sets a value of primary transfer voltage to be applied from the primary transfer power source 200 to the primary transfer members 59 in the primary transfer of the job.

If an output of the primary transfer power source 200 is turned on, voltage is applied to the primary transfer members 59. At this time, as illustrated in FIG. 17, while a current Id' flows in the primary transfer member 59*d*, currents do not flow in the primary transfer members 59*a* to 59*c*. More specifically, because the intermediate transfer belt 54 and the primary transfer members 59*a* to 59*c* are in a separated state, current pathways connected to the GND via the primary transfer members 59*a* to 59*c* and the photosensitive drums 56*a* to 56*c* are cut off and the currents Ia to Ic illustrated in FIG. 16A do not flow. Meanwhile, because the intermediate transfer belt 54 and the primary transfer member 59*d* are in a contact state, by a current pathway connected to the GND via the primary transfer member 59*d* and the photosensitive drum 56*d*, the current Id flows in the primary transfer member 59.

The current Id' flowing in the primary transfer member 59*d* flows from the GND to the operational amplifier 204 as the total current It, and then, returns to the primary transfer power source 200 from the output terminal of the operational amplifier 204 via the resistor 205. Based on Formula 1 and the voltage Vtisns output from the current detection circuit 201, the controller 10 can detect a value of a current flowing in the primary transfer member 59*d*.

[Example Relationship between Primarily Transfer Current and Primary Transfer Voltage]

Next, a relationship between primary transfer voltage applied to the primary transfer member 59 and the total current It detected by the current detection circuit 201 under each condition will be described with reference to FIGS. 18A to 18F. Dotted-line graphs illustrated in FIGS. 18B to 18F correspond to a graph illustrated in FIG. 18A.

Figure 18A:
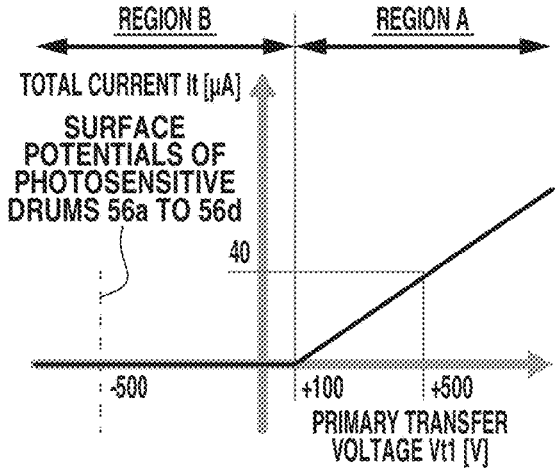
FIGS. 18A, 18B, 18C, 18D, 18E, and 18F are schematic diagrams each illustrating a relationship between voltage applied to a primary transfer member and a current flowing in the primary transfer member according to the fifth example embodiment.
Figure 18B:
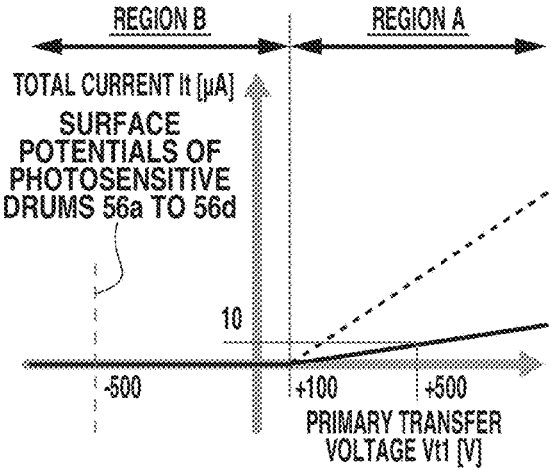

FIG. 18A illustrates a graph indicating a relationship between voltage (the primary transfer voltage Vt1) output from the primary transfer power source 200 to the primary transfer members 59 and the total current It detected by the current detection circuit 201 in the full color mode according to the present example embodiment. FIG. 18B illustrates a graph indicating a relationship between voltage (the primary transfer voltage Vt1) output from the primary transfer power source 200 to the primary transfer member 59*d* and the total current It detected by the current detection circuit 201 in the monochrome mode according to the present example embodiment.

Under the condition illustrated in FIG. 18A, after the photosensitive drum 56 is charged by the charging roller 57 to −500 [V] similarly to the image formation time, laser exposure of an image formation region is not performed by the exposure unit 60. The surface potential of the photosensitive drum 56 is thereby set to about −500) [V]. The primary transfer member 59 is brought into contact with the intermediate transfer belt 54, and an intermediate transfer belt with a surface resistance ρs of $1.0\times10^{9.5}$ [Ω/□] is used as the intermediate transfer belt 54. The measurement has been performed under the environment with room temperature of 25° C. and humidity of 80%.

As illustrated in FIG. 18A, a relationship between the primary transfer voltage Vt1 and the total current It can be divided into two regions including a region A and a region B. The region A is a region in which the primary transfer voltage Vt1 is larger than +100 [V], and the region B is a region in which the primary transfer voltage Vt1 is smaller than or equal to +100 [V]. When the primary transfer voltage Vt1 is +500 [V], the total current It becomes 40 [μA].

In the region A, if the primary transfer voltage Vt1 (+100 [V] or more) is applied from the primary transfer power source 200 to the primary transfer member 59, a potential difference between the surface of the photosensitive drum 56 and the surface of the intermediate transfer belt 54 exceeds a discharge threshold (about 600 [V] in the present example embodiment). Thus, discharge is generated between the surface of the photosensitive drum 56 and the surface of the intermediate transfer belt 54, and a current flows in the photosensitive drum 56.

Meanwhile, in the region B, even if the primary transfer voltage Vt1 is applied from the primary transfer power source 200 to the primary transfer member 59, a potential difference between the surface of the photosensitive drum 56 and the surface of the intermediate transfer belt 54 is smaller than or equal to the discharge threshold. Thus, a current does not flow in the photosensitive drum 56 because discharge is not generated between the surface of the photosensitive drum 56 and the surface of the intermediate transfer belt 54. The relationship between the primary transfer voltage Vt1 and the total current It detected by the current detection circuit 201 becomes a proportional relationship in which the primary transfer voltage Vt1 passes through the position of +100 [V].

FIG. 18B will be described. As already described with reference to FIG. 17, in the monochrome mode, because the primary transfer members 59*a* to 59*c* are separated from the intermediate transfer belt 54, a current flows only in the primary transfer member 59*d*. As a result, as illustrated in FIG. 18B, when the primary transfer voltage Vt1 is +500 [V], the total current It becomes 10 [μA]. In this manner, in the monochrome mode, the graph indicating the relationship between the primary transfer voltage Vt1 and the total current It detected by the current detection circuit 201 has a slope smaller than that in FIG. 18A.

In the region A, if the primary transfer voltage Vt1 of +100 [V] or more is applied from the primary transfer power source 200 to the primary transfer member 59, a potential difference between the surface of the photosensitive drum 56*d* and the surface of the intermediate transfer belt 54 exceeds the discharge threshold, and a current flows in the primary transfer portion N1*d*. Meanwhile, in the region B, similarly to FIG. 18A, a current does not flow in the photosensitive drum 56. The relationship between the primary transfer voltage Vt1 and the total current It detected by the current detection circuit 201 becomes a proportional relationship in which the primary transfer voltage Vt1 passes through the position of +100 [V].

As described above with reference to FIGS. 18A and 18B, the relationship between the total current It and the primary transfer voltage Vt1 changes in accordance with a contact/separated state of the intermediate transfer belt 54 and the primary transfer member 59.

Figure 18C:
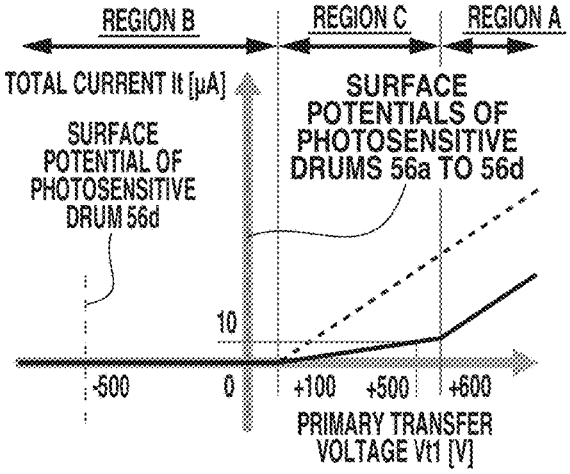
Figure 18D:
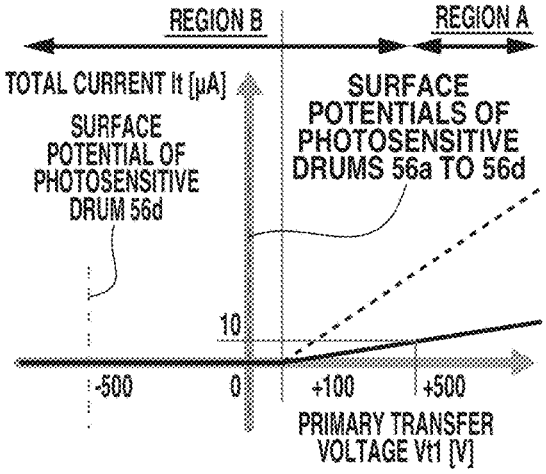

FIG. 18C illustrates a graph indicating a relationship between the primary transfer voltage Vt1 and the total current It in a case where the photosensitive drums 56*a* to 56*c* are not charged by the charging rollers 57*a* to 57*c* in the full color mode of the image forming apparatus 100. FIG. 18D illustrates a graph indicating a relationship between the primary transfer voltage Vt1 and the total current It in a case where the photosensitive drums 56*a* to 56*c* are not charged by the charging rollers 57*a* to 57*c* in the monochrome mode of the image forming apparatus 100.

As illustrated in FIG. 18C, in the region A, if the primary transfer voltage Vt1 of +600 [V] or more is applied from the primary transfer power source 200 to the primary transfer member 59, a potential difference between the surface of the photosensitive drum 56 and the surface of the intermediate transfer belt 54 exceeds the discharge threshold. In this process, discharge is generated between the surface of the photosensitive drum 56 and the surface of the intermediate transfer belt 54, and a current flows in the photosensitive drum 56. Thus, the slope of the graph indicating the relationship between the primary transfer voltage Vt1 and the total current It detected by the current detection circuit 201 in the region A becomes substantially equal as compared with FIG. 18A. On the other hand, in the region B, similarly to the region B in FIG. 18A, a current does not flow in the photosensitive drum 56.

Then, as illustrated in FIG. 18C, in a region C, a potential difference between the surface of the photosensitive drum 56*d* charged by the charging roller 57*d*, and the surface of the intermediate transfer belt 54 exceeds the discharge threshold. Meanwhile, a potential difference between the surfaces of the photosensitive drums 56*a* to 56*c* not charged by the charging rollers 57*a* to 57*c* and the surface of the intermediate transfer belt 54 does not exceed the discharge threshold. Thus, in the region C, discharge is generated between the surface of the photosensitive drum 56*d* and the surface of the intermediate transfer belt 54, and a current flows only in the photosensitive drum 56*d*. As a result, the relationship between the primary transfer voltage Vt1 and the total current It detected by the current detection circuit 201 in the region C becomes a proportional relationship in which the primary transfer voltage Vt1 passes through the position of +100 [V], and the slope changes at the position of +600 [V] being a boundary with the region A.

FIG. 18D will be described. As illustrated in FIG. 18D, in the second state in which the primary transfer members 59*a* to 59*c* are separated from the intermediate transfer belt 54, even if the charging rollers 57*a* to 57*c* stop charging the photosensitive drums 56*a* to 56*c*, a graph similar to FIG. 18B is obtained. In the second state in which the primary transfer members 59*a* to 59*c* are not in contact with the intermediate transfer belt 54, currents do not flow in the primary transfer portions N1*a* to N1*c* irrespective of surface potentials of the photosensitive drums 56*a* to 56*c*.

More specifically, in the region A, if the primary transfer voltage Vt1 of +100 [V] or more is applied from the primary transfer power source 200 to the primary transfer member 59, a potential difference between the surface of the photosensitive drum 56*d* and the surface of the intermediate transfer belt 54 exceeds the discharge threshold, and a current flows in the photosensitive drum 56*d*. Meanwhile, in the region B, similarly to FIG. 18A, a current does not flow in the photosensitive drum 56. The relationship between the primary transfer voltage Vt1 and the total current It detected by the current detection circuit 201 becomes a proportional relationship in which the primary transfer voltage Vt1 passes through the position of +100 [V].

As described above with reference to FIGS. 18C to 18D, the relationship between the total current It and the primary transfer voltage Vt1 changes also in accordance with the surface potential of the photosensitive drum 56.

Figure 18E:
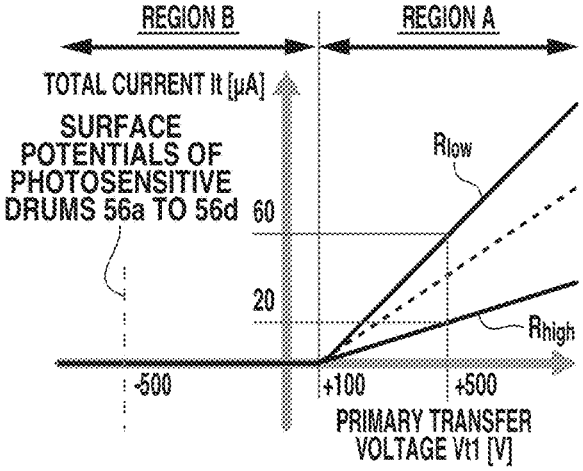

FIG. 18E illustrates a graph indicating a relationship between the primary transfer voltage Vt1 and the total current It in the full color mode in a case where a usage environment of the image forming apparatus 100 changes. In FIG. 18E, in a case where the primary transfer voltage Vt1 applied to the primary transfer member 59 is +100 [V] or more, a current flows in the photosensitive drum 56 irrespective of an electric resistance value of the intermediate transfer belt 54. In other words, under each condition illustrated in FIG. 18E, similarly to FIG. 18A, the relationship between the primary transfer voltage Vt1 and the total current It detected by the current detection circuit 201 becomes a proportional relationship in which the primary transfer voltage Vt1 passes through the position of +100 [V].

In some cases, a surface resistance of the intermediate transfer belt 54 varies in accordance with a change in usage environment of the image forming apparatus 100. In FIG. 18A, a surface resistance ρs of the intermediate transfer belt 54 is $1.0\times10^{9.5}$ [Ω/□]. Meanwhile, a graph $R_{LOW}$ in FIG. 18E indicates a relationship between the primary transfer voltage Vt1 and the total current It that is obtainable when a surface resistance ρs of the intermediate transfer belt 54 decreases to $1.0\times10^{7}$ [Ω/□]. A graph $R_{High}$ in FIG. 18E indicates a relationship between the primary transfer voltage Vt1 and the total current It that is obtainable when a surface resistance ρs of the intermediate transfer belt 54 increases to $1.0\times10^{11}$ [Ω/□].

As indicated by the graph $R_{LOW}$, in a case where a surface resistance ρs of the intermediate transfer belt 54 decreases to $1.0\times10^{7}$ [Ω/□], the total current It becomes 60 [IA] when the primary transfer voltage Vt1 is +500 [V]. In the graph $R_{LOW}$, because a resistance value of the intermediate transfer belt 54 decreases, as compared with FIG. 18A, a current flows in the photosensitive drum 56 more easily. Thus, the graph indicating the relationship between the primary transfer voltage Vt1 and the total current It detected by the current detection circuit 201 has a slope larger than that in FIG. 18A.

Then, as indicated by the graph $R_{High}$, in a case where the usage environment of the intermediate transfer belt 54 changes and the surface resistance ρs increases to $1.0\times10^{11}$ [Ω/□], when the primary transfer voltage Vt1 is +500 [V], the total current It becomes 20 [μA]. As for the graph $R_{LOW}$, because a resistance value of the intermediate transfer belt 54 increases, as compared with FIG. 18A, a current flows in the photosensitive drum 56 less easily. Thus, the graph indicating the relationship between the primary transfer voltage Vt1 and the total current It detected by the current detection circuit 201 has a slope smaller than that in FIG. 18A.

Figure 18F:
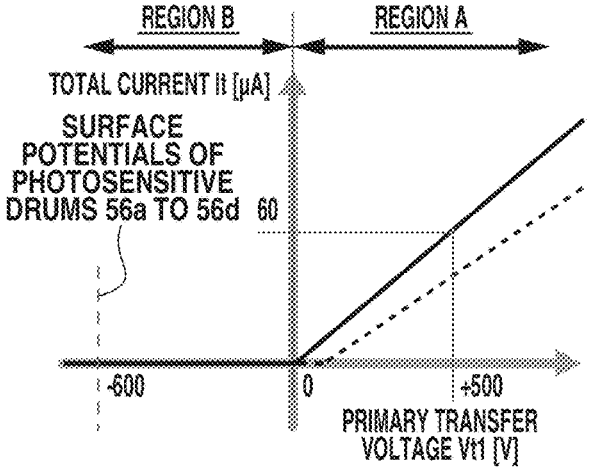

Lastly, FIG. 18F will be described. FIG. 18F illustrates a graph indicating a relationship between the primary transfer voltage Vt1 and the total current It in the full color mode in a case where a surface film thickness of the photosensitive drum 56 becomes thinner by continuously using the image forming apparatus 100. If a film thickness of the photosensitive drum 56 becomes thinner, as a potential difference generated in an air gap between the charging roller 57 and the photosensitive drum 56 becomes larger, an absolute value of the surface potential of the charged photosensitive drum 56 becomes larger. More specifically, as illustrated in FIG. 18F, the surface potential of the charged photosensitive drum 56 becomes about −600 [V].

As a result, in FIG. 18F, in the region A, if the primary transfer voltage Vt1 of +0 [V] or more is applied from the primary transfer power source 200 to the primary transfer member 59, a potential difference between the surface of the photosensitive drum 56 and the surface of the intermediate transfer belt 54 exceeds the discharge threshold. In this process, discharge is generated between the surface of the photosensitive drum 56 and the surface of the intermediate transfer belt 54, and a current flows in the photosensitive drum 56. Thus, under the condition illustrated in FIG. 18F, the relationship between the primary transfer voltage Vt1 and the total current It detected by the current detection circuit 201 becomes a proportional relationship in which the primary transfer voltage Vt1 passes through the position of 0 [V].

As compared with FIG. 18A, under the condition illustrated in FIG. 18F, a current flows in the photosensitive drum 56 more easily, and when the primary transfer voltage Vt1 is +500 [V], the total current It becomes 60 [μA]. In other words, as illustrated in FIG. 18F, the graph indicating the relationship between the primary transfer voltage Vt1 and the total current It detected by the current detection circuit 201 has a slope larger than that in FIG. 18A.

As described above, as seen from the results of the graphs illustrated in FIGS. 18A to 18F, the relationship between the total current It and the primary transfer voltage Vt1 varies in accordance with a contact/separated state of the intermediate transfer belt 54 and the primary transfer member 59, the surface potential of the photosensitive drum 56, or a resistance value of the intermediate transfer belt 54.

[Example Detection of Contact State between Primary Transfer Member and Intermediate Transfer Belt]

Figure 19:
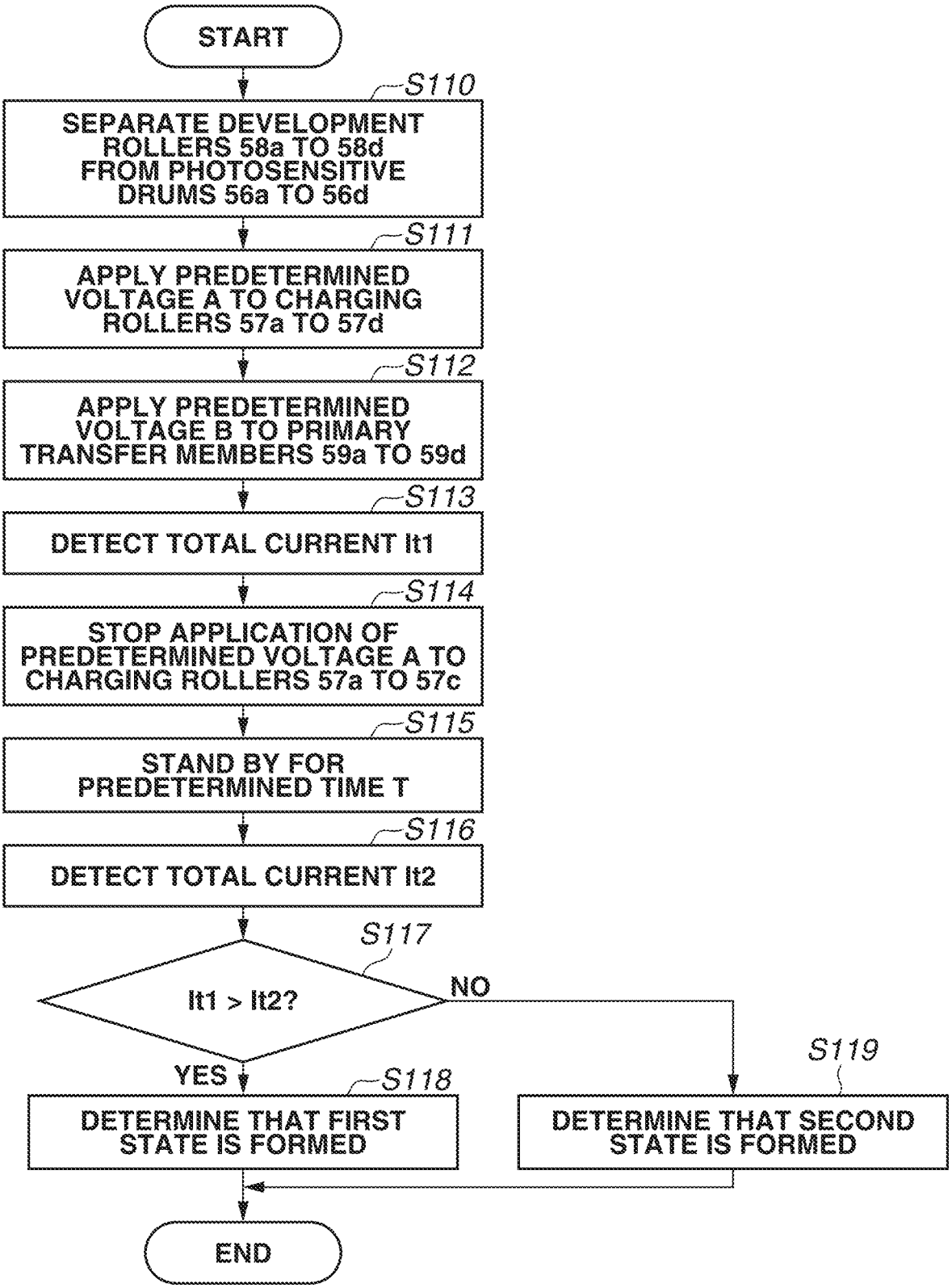
FIG. 19 is a flowchart illustrating a detection method of a contact state between a primary transfer member and an intermediate transfer member according to the fifth example embodiment.

FIG. 19 is a flowchart illustrating a detection method of a contact state between the primary transfer members 59 and the intermediate transfer belt 54 according to the present example embodiment.

As illustrated in FIG. 19, in the case of detecting a contact state between the primary transfer member 59 and the intermediate transfer belt 54, first of all, in step S110, the development rollers 58*a*. 58*b*, 58*c*, and 58*d* are separated. The surfaces of photosensitive drums 56*a*, 56*b*, 56*c*, and 56*d* having the surface potential are thereby brought to the positions of the respective primary transfer members 59*a*, 59*b*, 59*c*, and 59*d* without toner adhering to the surfaces. After that, in step S111, the predetermined voltage Va is applied from the charging power sources 401 and 402 to the charging rollers 57*a*, 57*b*. 57*c*, and 57*d*. Then, in step S112, the predetermined voltage Vb is applied from the primary transfer power source 200 to the primary transfer members 59*a*, 59*b*. 59*c*, and 59*d*. The predetermined voltage Va and the predetermined voltage Vb are determined in accordance with the generated voltage values thereof based on a calculation formula or a lookup table obtained in advance. In the present example embodiment, the predetermined voltage Va is set to −1000 [V] and the predetermined voltage Vb is set to 350 [V].

After that, in step S113, the current detection circuit 201 detects a total current It1 (first current value). Then, in step S114, the application of the predetermined voltage Va from the charging power source 401 to the charging rollers 57*a*, 57*b*, and 57*c* is stopped. The charging rollers 57*a*, 57*b*, and 57*c* thereby stop charging the photosensitive drums 56*a*, 56*b*, and 56*c*. Then, by keeping the detection performed by the current detection circuit 201 on standby for a predetermined time T in step S115, the surfaces of the photosensitive drums 56*a*, 56*b*, and 56*c* not charged by the charging rollers 57*a*, 57*b*, and 57*c* reach the primary transfer portions N1*a*, N1*b*, and N1*c*.

The predetermined time T is set to at least a time larger than or equal to a time required for the photosensitive drum 56 rotationally moving by a distance from positions at which the charging rollers 57 and the photosensitive drums 56 face, to the primary transfer portions N1*a*, N1*b*, and N1*c*, with respect to the rotational moving direction of the photosensitive drum 56. By setting the predetermined time T in this manner, if the predetermined time T elapses, the surfaces of the photosensitive drums 56*a*, 56*b*, and 56*c* not charged by the charging rollers 57*a*, 57*b*, and 57*c* reach the primary transfer portions N1*a*, Ni*b*, and N1*c*.

Subsequently, in step S116, the current detection circuit 201 detects a total current It2 (second current value). Then, in step S117, the value of the total current It1 and the value of the total current It2 are compared. As described above with reference to FIGS. 18A and 18C, in the full color mode, that is to say, in the first state in which the primary transfer members 59 are in contact with the intermediate transfer belt 54, the current detected by the current detection circuit 201 decreases by stopping the charging performed by the charging rollers 57*a* to 57*c*. Thus, if the value of the total current It1 is larger than the value of the total current It2 (YES in step S117), the processing proceeds to step S118. In step S118, the controller 10 determines that the contact state is the first state in which the primary transfer members 59 are in contact with the intermediate transfer belt 54.

Meanwhile, as described above with reference to FIGS. 18B and 18D, in the monochrome mode, i.e., in the second state in which only the primary transfer member 59*d* is in contact with the intermediate transfer belt 54, even if the charging rollers 57*a* to 57*c* stop charging, the current detected by the current detection circuit 201 does not change. Thus, if the value of the total current It1 is smaller than or equal to the value of the total current It2 (NO in step S117), the processing proceeds to step S119. In step S119, the controller 10 determines that the contact state is the second state in which the primary transfer member 59*d* and the intermediate transfer belt 54 are in contact with each other and the primary transfer members 59*a* to 59*c* are separated from the intermediate transfer belt 54.

The above determination will be described in more detail. If the primary transfer voltage Vt1 of +500 [V] is applied in a state in which the photosensitive drum 56 is charged to −500 [V] in the first state, the total current It becomes 40 [IμA] as illustrated in FIG. 18A. If the primary transfer voltage Vt1 of +500 [V] is applied in a state in which the photosensitive drums 56*a*. 56*b*, and 56*c* are not charged and only the photosensitive drum 56*d* is charged in the first state, the total current It becomes 10 [μA] as illustrated in FIG. 18C.

Meanwhile, if the primary transfer voltage Vt1 of +500 [V] is applied in a state in which the photosensitive drum 56 is charged to −500 [V] in the second state, the total current It becomes 10 [μA] as illustrated in FIG. 18B. If the primary transfer voltage Vt1 of +500 [V] is applied in a state in which the photosensitive drums 56*a*, 56*b*, and 56*c* are not charged and only the photosensitive drum 56*d* is charged in the second state, the total current It becomes 10 [μA] as illustrated in FIG. 18D.

In this manner, in the first state, after the charging rollers 57*a* to 57*c* stop charging the photosensitive drums 56*a* to 56*c*, the value of the total current It changes from the value obtained before the stop. Thus, by comparing the value of the total current It1 and the value of the total current It2 in step S117 illustrated in FIG. 19, the controller 10 can determine which state of the first state and the second state is formed.

As described above, in the present example embodiment, the contact state between the primary transfer member 59 and the intermediate transfer belt 54 is determined based on a detection result obtained by the current detection circuit 201 before the charging rollers 57*a* to 57*c* stop charging the photosensitive drums 56*a* to 56*c*, and a detection result obtained by the current detection circuit 201 after the stop. With this configuration, in the configuration of applying voltage from the primary transfer power source 200 to the plurality of primary transfer members 59, determination of a contact state between the primary transfer member 59 and the intermediate transfer belt 54 can be accurately performed based on a detection result obtained by the current detection circuit 201.

While, in the present example embodiment, the description has been given of the configuration in which the current detection circuit 201 detects a total value of currents flowing in the respective primary transfer members 59, when the primary transfer voltage Vt1 is applied to the primary transfer members 59, the configuration is not limited to this. As long as at least the potential difference between the photosensitive drum 56 and the intermediate transfer belt 54 exceeds the discharge threshold, the total current It can be detected. Thus, for example, if the predetermined voltage Va is set to a value with a large absolute value, and the surface potential of the photosensitive drum 56 is set to a value larger toward a minus side than −600 [V] which is the discharge threshold, detection of the total current It can be performed without the primary transfer voltage Vt1.

As illustrated in FIGS. 18E and 18F, the value of the total current It is affected by a usage state of the image forming apparatus 100. Meanwhile, according to the configuration of the present example embodiment, detection of the total current It can be performed under the same condition except for the setting of the surface potentials of the photosensitive drums 56. In other words, as compared with the configuration of comparing a total current value with a preset predetermined threshold, determination of a contact state between the primary transfer member 59 and the intermediate transfer belt 54 can be performed more accurately.

While, in the present example embodiment, a method of making a distinction between the full color mode and the monochrome mode has been described, the present disclosure can also be used in the case of detecting a mode other than these modes. For example, there can be considered various combinations of modes such as a two-color mode in which image formation is performed using only the image forming units 64*a* and 64*b* respectively storing yellow toner and magenta toner, and a three-color mode in which image formation is performed using only the image forming units 64*a*, 64*b*, and 64*c* respectively storing yellow toner, magenta toner, and cyan toner. Also in an image forming apparatus having such various color modes, by using the detection method described in the present example embodiment, it is possible to identify a primary transfer member that is in contact with an intermediate transfer belt.

While, in the present example embodiment, the predetermined voltage Va and the predetermined voltage Vb are determined in accordance with the generated voltage values thereof based on a calculation formula or a lookup table obtained in advance, the predetermined voltage Va and the predetermined voltage Vb are not limited to the values determined in this manner. For example, the predetermined voltage Va and the predetermined voltage Vb may be values further corrected in accordance with a detection result of the environment sensor 106.

While, in the present example embodiment, by separating the development roller 58 from the photosensitive drum 56, toner is prevented from adhering to the photosensitive drum 56 the configuration is not limited to this. Alternatively, and a state in which the development roller 58 is in contact with the photosensitive drum 56 may be maintained. In this case, for example, by applying voltage with opposite polarity to that in an image formation time as voltage applied from the development power source 500 to the development roller 58, control can be performed in such a manner that toner borne on the development roller 58 is not moved to the photosensitive drum 56.

While, in the present example embodiment, a conductive brush member is used as the primary transfer member 59, the primary transfer member 59 is not limited to this. Alternatively, a roller member including a conductive elastic layer, a conductive sheet member, or a metal roller can also be used.

While, in the present example embodiment, a configuration that can separate the primary transfer members 59*a* to 59*d* from the intermediate transfer belt 54 has been described, the configuration is not limited to this. For example, a configuration of causing the primary transfer member 59*d* corresponding to the image forming unit 64*d* storing black toner to be always in contact with the intermediate transfer belt 54 may be employed. That is to say, a configuration in which the primary transfer member 59*d* and the intermediate transfer belt 54 are always in contact with each other may be employed. In this case, such contact control can be performed by employing an urging configuration of causing only the primary transfer members 59*a* to 59*c* to be in contact with or separated from the intermediate transfer belt 54.

While, in the present example embodiment, a configuration of applying voltage from the common primary transfer power source 200 to all the primary transfer members 59*a* to 59*d* is used, the configuration is not limited to this. Alternatively, voltage from a common primary transfer power source may be applied only to a part of the primary transfer members 59. More specifically, by using a common primary transfer power source for applying voltage to at least two primary transfer members, the effects described in the present example embodiment can be obtained.

In the fifth example embodiment, the description has been given of the configuration of switching the surface potentials of the photosensitive drums 56*a* to 56*c* by stopping the charging performed by the charging rollers 57*a* to 57*c*, for determining which state of the first state and the second state is formed. Meanwhile, the second example embodiment differs from the fifth example embodiment in that the surface potentials of the photosensitive drums 56*a* to 56*c* are switched by exposing the photosensitive drums 56*a* to 56*c* by the exposure units 60*a* to 60*c*. In the following description, configurations and controls of the sixth example embodiment that are similar to those in the fifth example embodiment are assigned the same reference numerals, and the description will be omitted.

Figure 20:
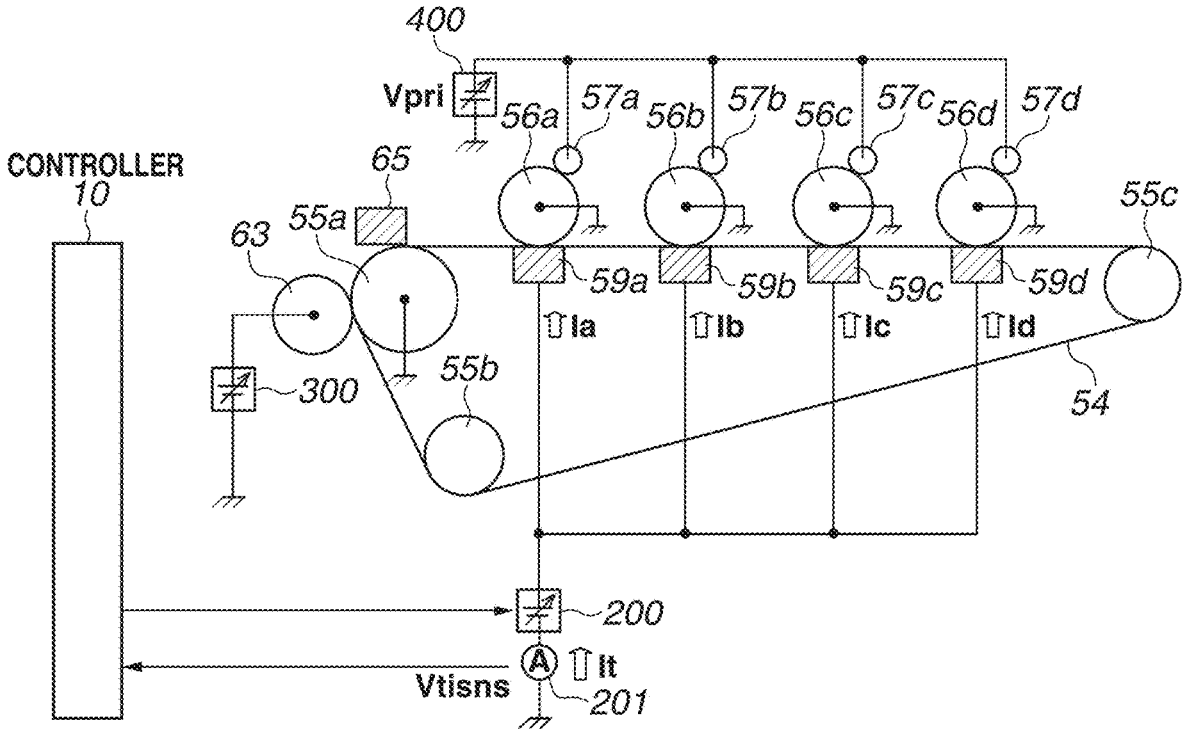
FIG. 20 is a schematic diagram illustrating a power source configuration according to a sixth example embodiment.

FIG. 20 is a schematic diagram illustrating a current flowing in a primary transfer member in the full color mode according to the present example embodiment. As seen from the comparison between FIGS. 20 and 16A, in the present example embodiment, voltage is applied to the charging rollers 57 from the common charging power source 400. The detailed description will be given below. In the present example embodiment, the surface potentials of the photosensitive drums 56*a* to 56*c* are switched by exposing the photosensitive drums 56*a* to 56*c* by the exposure units 60*a* to 60*c* without stopping the charging performed by the charging rollers 57*a* to 57*c*. For this reason, there is no need to separately provide charging power sources for applying voltage to the charging rollers 57*a* to 57*c*, and to the charging roller 57*d*, and the common charging power source 400 can be used as illustrated in FIG. 20.

While, in the present example embodiment, the configuration of applying voltage to the charging rollers 57 from the common charging power source 400 is employed, the configuration is not limited to this. For example, charging power sources may be individually provided for the respective charging rollers 57*a* to 57*d*, or a common charging power source may be provided for some charging rollers of the charging rollers 57*a* to 57*d*. Alternatively, the configuration of the charging power sources that is similar to the fifth example embodiment may be employed.

[Example Relationship between Primarily Transfer Current and Primary Transfer Voltage]

Figure 21A:
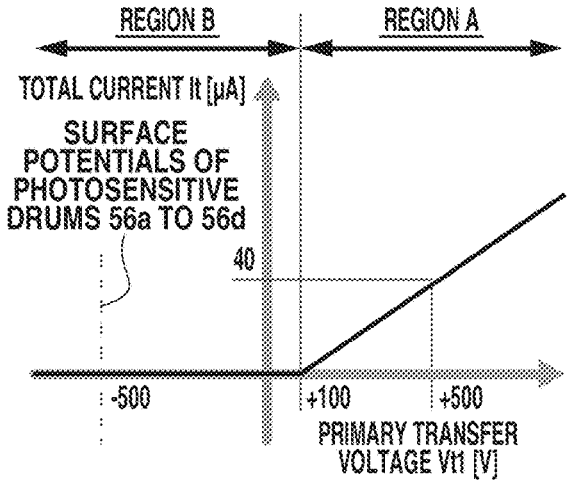
FIGS. 21A, 21B, 21C, and 21D are schematic diagrams each illustrating a relationship between voltage applied to a primary transfer member and a current flowing in the primary transfer member according to the sixth example embodiment.
Figure 21B:
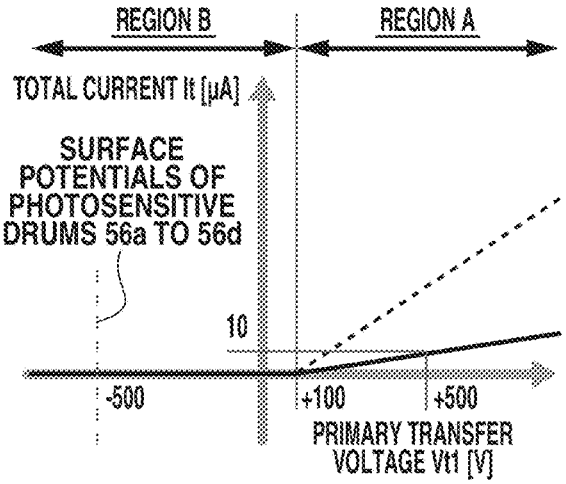

Next, a relationship between primary transfer voltage applied to the primary transfer member 59 and the total current It detected by the current detection circuit 201 in a case where the exposure units 60*a* to 60*c* expose the photosensitive drums 56*a* to 56*c* will be described with reference to FIGS. 21C to 21D. FIGS. 21A to 21B illustrate graphs indicating the relationship between the primary transfer voltage Vt1 and the total current It in a case where the photosensitive drums 56*a* to 56*c* are not exposed by the exposure units 60*a* to 60*c*. FIGS. 21A to 21B are provided as a reference for comparison with FIGS. 21C to 21D, and illustrate the same graphs as those illustrated in FIGS. 18A to 18B.

Figure 21C:
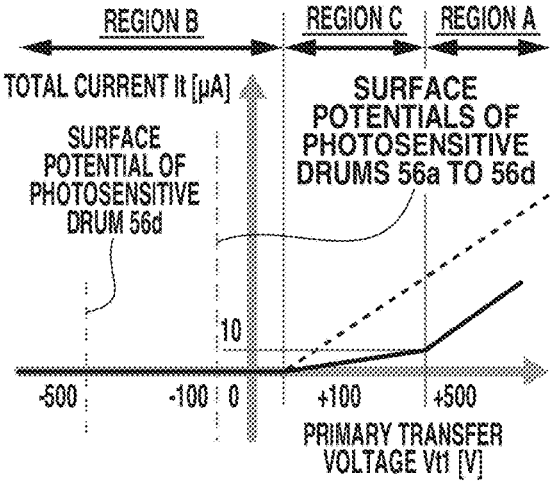

FIG. 21C illustrates a graph indicating a relationship between the primary transfer voltage Vt1 and the total current It in the full color mode of the image forming apparatus 100 in a case where the photosensitive drums 56*a* to 56*c* are exposed by the exposure units 60*a* to 60*c*. FIG. 21D illustrates a graph indicating a relationship between the primary transfer voltage Vt1 and the total current It in the monochrome mode of the image forming apparatus 100 in a case where the photosensitive drums 56*a* to 56*c* are exposed by the exposure units 60*a* to 60*c*. Dotted-line graphs illustrated in FIGS. 21B to 21D correspond to the graph illustrated in FIG. 21A.

Figure 21D:
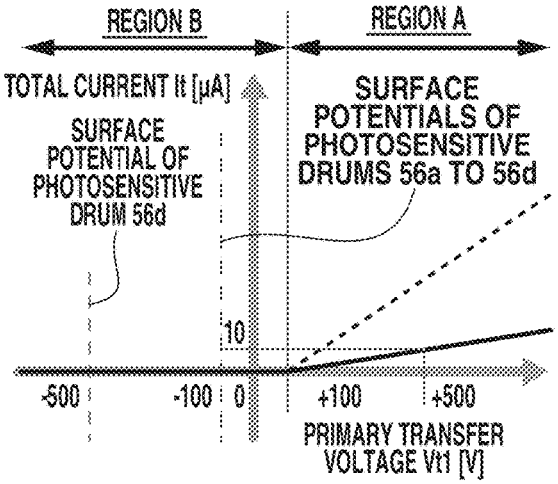

As illustrated in FIGS. 21C and 21D, because the photosensitive drums 56*a* to 56*c* are exposed by the exposure units 60*a* to 60*c*, the surface potentials of the photosensitive drums 56*a* to 56*c* become −100 [V]. Because the photosensitive drum 56*d* is not exposed by the exposure unit 60*d*, the surface potential of the photosensitive drum 56*d* becomes −500 [V]. In FIGS. 21C and 21D, when the primary transfer voltage Vt1 is +500 [V], the total current It becomes 10 [A].

As illustrated in FIG. 21C, in the region A, if the primary transfer voltage Vt1 of +500 [V] or more is applied from the primary transfer power source 200 to the primary transfer member 59, a potential difference between the surface of the photosensitive drum 56 and the surface of the intermediate transfer belt 54 exceeds the discharge threshold. In this process, discharge is generated between the surface of the photosensitive drum 56 and the surface of the intermediate transfer belt 54, and a current flows in the photosensitive drum 56. Thus, the slope of the graph indicating the relationship between the primary transfer voltage Vt1 and the total current It detected by the current detection circuit 201 in the region A becomes substantially equal as compared with FIG. 21A. On the other hand, in the region B, similarly to the region B in FIG. 21A, a current does not flow in the photosensitive drum 56.

Then, as illustrated in FIG. 21C, in the region C, a potential difference between the surface of the photosensitive drum 56*d* not exposed by the exposure unit 60*d* after being charged by the charging roller 57*d* and the surface of the intermediate transfer belt 54 exceeds the discharge threshold. Meanwhile, a potential difference between the surfaces of the photosensitive drums 56*a* to 56*c* exposed by the exposure units 60*a* to 60*c* and the surface of the intermediate transfer belt 54 does not exceed the discharge threshold. Thus, in the region C, discharge is generated between the surface of the photosensitive drum 56*d* and the surface of the intermediate transfer belt 54, and a current flows only in the photosensitive drum 56*d*. As a result, the relationship between the primary transfer voltage Vt1 and the total current It detected by the current detection circuit 201 in the region C becomes a proportional relationship in which the primary transfer voltage Vt1 passes through the position of +100 [V], and the slope changes at the position of +500 [V] being a boundary with the region A. In addition, the slope of the graph indicating the relationship between the primary transfer voltage Vt1 and the total current It in the region C is smaller than that in FIG. 21A.

Next, FIG. 21D will be described. As illustrated in FIG. 21D, in the second state in which the primary transfer members 59*a* to 59*c* are separated from the intermediate transfer belt 54, if the surfaces of the photosensitive drums 56*a* to 56*c* are exposed by the exposure units 60*a* to 60*c*, a graph similar to FIG. 21B is obtained. In the second state in which the primary transfer members 59*a* to 59*c* are not in contact with the intermediate transfer belt 54, currents do not flow in the primary transfer portions N1*a* to N1*c* irrespective of the surface potentials of the photosensitive drums 56*a* to 56*c*.

More specifically, in the region A, if the primary transfer voltage Vt1 of +100 [V] or more is applied from the primary transfer power source 200 to the primary transfer member 59, a potential difference between the surface of the photosensitive drum 56*d* and the surface of the intermediate transfer belt 54 exceeds the discharge threshold, and a current flows in the photosensitive drum 56*d*. Meanwhile, in the region B, similarly to FIG. 21A, a current does not flow in the photosensitive drum 56. In the region A, the relationship between the primary transfer voltage Vt1 and the total current It detected by the current detection circuit 201 becomes a proportional relationship in which the primary transfer voltage Vt1 passes through the position of +100 [V]. The slope of the graph indicating the relationship between the primary transfer voltage Vt1 and the total current It in the region A is smaller than that in FIG. 21A.

[Example Detection of Contact State between Primary Transfer Member and Intermediate Transfer Belt]

Figure 22:
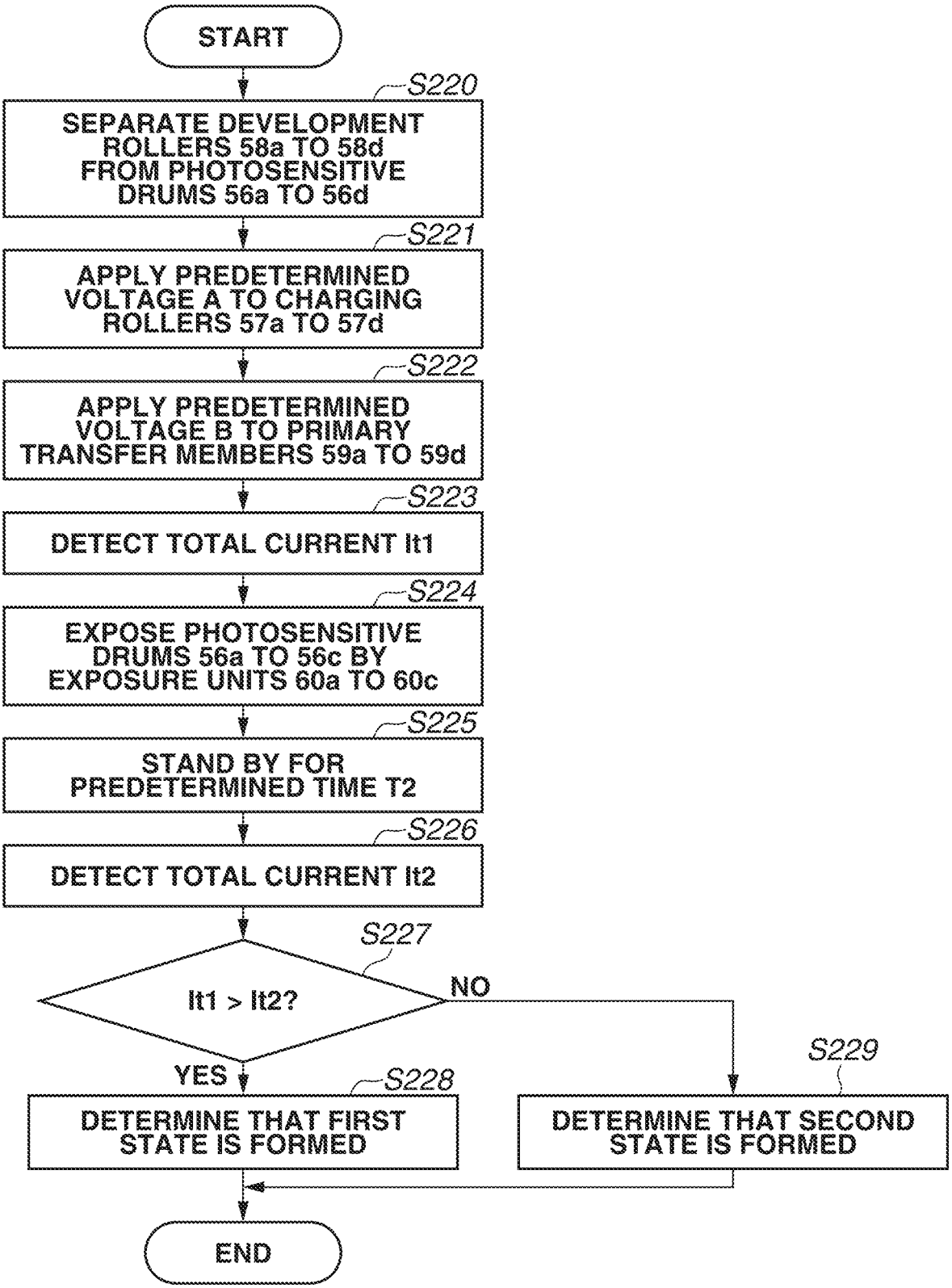
FIG. 22 is a flowchart illustrating a detection method of a contact state between a primary transfer member and an intermediate transfer member according to the sixth example embodiment.

FIG. 22 is a flowchart illustrating a detection method of a contact state between the primary transfer members 59 and the intermediate transfer belt 54 according to the present example embodiment.

As illustrated in FIG. 22, in the case of detecting a contact state between the primary transfer member 59 and the intermediate transfer belt 54, first of all, in step S220, the development rollers 58*a*, 58*b*, 58*c*, and 58*d* are separated. The surfaces of photosensitive drums 56*a*, 56*b*. 56*c*, and 56*d* having the surface potential are thereby brought to the positions of the respective primary transfer members 59*a*, 59*b*, 59*c*, and 59*d* without toner adhering to the surfaces. After that, in step S221, the predetermined voltage Va is applied from the charging power source 400 to the charging rollers 57*a*, 57*b*, 57*c*, and 57*d*. Then, in step S222, the predetermined voltage Vb is applied from the primary transfer power source 200 to the primary transfer members 59*a*, 59*b*, 59*c*, and 59*d*. The predetermined voltage Va and the predetermined voltage Vb are determined in accordance with the generated voltage values thereof based on a calculation formula or a lookup table obtained in advance.

After that, in step S223, the current detection circuit 201 detects the total current It1 (first current value). Then, in step S224, the photosensitive drums 56*a*, 56*b*, and 56*c* are exposed by the exposure units 60*a*, 60*b*, and 60*c*. The surface potentials of the photosensitive drums 56*a*, 56*b*, and 56*c* are thereby switched. In the present example embodiment, in step S224, the controller 10 controls the exposure control unit 101 in such a manner that the surface potentials of the photosensitive drums 56*a*, 56*b*, and 56*c* become about −100 [V].

Then, in step S225, the detection performed by the current detection circuit 201 is kept on standby for a predetermined time T2. The predetermined time T2 is set to at least a time larger than or equal to a time required for the photosensitive drum 56 rotationally moving by a distance from a position at which the photosensitive drum 56 is exposed by the exposure unit 60, to the primary transfer portions N1*a*, N1*b*, and N1*c*, with respect to a rotational moving direction of the photosensitive drum 56. By setting the predetermined time T2 in this manner, if the predetermined time T2 elapses, the surfaces of the photosensitive drums 56*a*, 56*b*, and 56*c* exposed by the exposure units 60*a*, 60*b*, and 60*c* reach the primary transfer portions N1*a*, N1*b*, and N1*c*.

Subsequently, in step S226, the current detection circuit 201 detects the total current It2 (second current). Then, in step S227, the value of the total current It1 and the value of the total current It2 are compared. As described above with reference to FIGS. 21A to 21D, in the first state in which the primary transfer members 59 are in contact with the intermediate transfer belt 54, the current detected by the current detection circuit 201 decreases by exposing the photosensitive drums 56*a* to 56*c* by the exposure units 60*a* to 60*c*. Thus, if the value of the total current It1 is larger than the value of the total current It2 (YES in step S227), the processing proceeds to step S228. In step S228, the controller 10 determines that the contact state is the first state in which the primary transfer members 59 are in contact with the intermediate transfer belt 54.

On the other hand, as described above with reference to FIGS. 21B and 21D, in the second state in which only the primary transfer member 59*d* is in contact with the intermediate transfer belt 54, even if the photosensitive drums 56*a* to 56*c* are exposed by the exposure units 60*a* to 60*c*, the current detected by the current detection circuit 201 does not change. Thus, if the value of the total current It1 is smaller than or equal to the value of the total current It2 (NO in step S227), the processing proceeds to step S229. In step S229, the controller 10 determines that the contact state is the second state in which the primary transfer member 59*d* and the intermediate transfer belt 54 are in contact with each other and the primary transfer members 59*a* to 59*c* are separated from the intermediate transfer belt 54.

As described above, according to the configuration of the present example embodiment, determination of which state of the first state and the second state is formed can be performed based on a detection result obtained by the current detection circuit 201 before the photosensitive drums 56*a* to 56*c* are exposed by the exposure units 60*a* to 60*c* and the surface potentials are switched, and a detection result obtained by the current detection circuit 201 after the exposure. With this configuration, in the configuration of applying voltage from the primary transfer power source 200 to the plurality of primary transfer members 59, a contact state between the primary transfer member 59 and the intermediate transfer belt 54 can be determined accurately based on a detection result obtained by the current detection circuit 201.

While the present disclosure has been described with reference to example embodiments, it is to be understood that the disclosure is not limited to the disclosed example embodiments. The scope of the following claims is to be accorded the broadest interpretation so as to encompass all such modifications and equivalent structures and functions.

This application claims the benefit of Japanese Patent Applications No. 2018-241795, filed Dec. 25, 2018, and No. 2018-241803, filed Dec. 25, 2018, which are hereby incorporated by reference herein in their entirety.

What is claimed is:

1. An image forming apparatus comprising:

a first image bearing member configured to bear a toner image;

a first charging member configured to charge the first image bearing member;

a second image bearing member configured to bear a toner image with a color different from the first image bearing member;

a first development member configured to be in contact with or separated from the first image bearing member, and to develop an electrostatic latent image formed on the first image bearing member using toner, in a state of being in contact with the first image bearing member;

a second development member configured to be in contact with or separated from the second image bearing member, and to develop an electrostatic latent image formed on the second image bearing member using toner, in a state of being in contact with the second image bearing member;

an intermediate transfer member onto which a toner image borne by at least one of the first image bearing member or the second image bearing member is transferred;

a first transfer member that is disposed at a position corresponding to the first image bearing member via the intermediate transfer member, and is configured to transfer a toner image onto the intermediate transfer member from the first image bearing member;

a second transfer member that is disposed at a position corresponding to the second image bearing member via the intermediate transfer member, and is configured to transfer a toner image onto the intermediate transfer member from the second image bearing member;

a transfer power source configured to apply voltage to the first transfer member and the second transfer member;

a detection unit configured to detect currents flowing in the first transfer member and the second transfer member, in a case where voltage is applied to the first transfer member and the second transfer member from the transfer power source; and a control unit configured to select and execute either a first mode of transferring a toner image onto the intermediate transfer member from at least one of the first image bearing member or the second image bearing member in a first state in which the first transfer member and the second transfer member are in contact with the intermediate transfer member, or a second mode of transferring a toner image onto the intermediate transfer member from the first image bearing member in a second state in which the first transfer member is in contact with the intermediate transfer member and the second transfer member is separated from the intermediate transfer member, wherein the control unit determines which state of the first state and the second state is formed, based on a detection result obtained by the detection unit when the first image bearing member is charged by the first charging member, the first development member is separated from the first image bearing member, the second development member is separated from the second image bearing member, and voltage is applied to the first transfer member and the second transfer member from the transfer power source.

2. The image forming apparatus according to claim 1, wherein the detection unit is electrically connected between the transfer power source and a ground, and detects a total value of the current flowing in the first transfer member and the current flowing in the second transfer member, in a case where voltage is applied to the first transfer member and the second transfer member from the transfer power source.

3. The image forming apparatus according to claim 2, wherein the control unit determines that the first state is formed, in a case where the total value is larger than a first threshold, and determines that the second state is formed, in a case where the total value is smaller than or equal to the first threshold.

4. The image forming apparatus according to claim 2, wherein the control unit obtains a first total value by applying voltage to the first transfer member and the second transfer member from the transfer power source, executes an operation of separating the second transfer member from the intermediate transfer member, obtains a second total value by applying voltage to the first transfer member and the second transfer member from the transfer power source, and determines which state of the first state and the second state is formed at a time point at which the first total value is obtained, based on comparison between the first total value and the second total value.

5. The image forming apparatus according to claim 4, wherein the control unit determines that a contact state of the first transfer member and the second transfer member with respect to the intermediate transfer member is switched from the first state to the second state, in a case where the first total value is larger than the second total value, and determines that the second state has been formed before the operation of separating the second transfer member from the intermediate transfer member is executed, in a case where the first total value is smaller than or equal to the second total value.

6. The image forming apparatus according to claim 1, further comprising:

a first exposure unit configured to expose the first image bearing member to form a first electrostatic latent image on the first image bearing member; and a second exposure unit configured to expose the second image bearing member to form a second electrostatic latent image on the second image bearing member, wherein the control unit determines which state of the first state and the second state is formed, based on a current detection result obtained by the detection unit when a position on the first image bearing member on which the first electrostatic latent image is formed passes through a position at which the first image bearing member and the intermediate transfer member is in contact with each other, and a current detection result obtained by the detection unit when a position on the second image bearing member on which the second electrostatic latent image is formed passes through a position at which the second image bearing member and the intermediate transfer member is in contact with each other.

7. The image forming apparatus according to claim 6, wherein the control unit determines which state of the first state and the second state is formed, based on the number of detections of a current minimum value detected by the detection unit when the position on the first image bearing member on which the first electrostatic latent image is formed passes through the position at which the first image bearing member and the intermediate transfer member is in contact with each other, and the number of detections of a current minimum value detected by the detection unit when the position on the second image bearing member on which the second electrostatic latent image is formed passes through the position at which the second image bearing member and the intermediate transfer member is in contact with each other.

8. The image forming apparatus according to claim 7, wherein the control unit determines that the first state is formed, in a case where the number of detections of a current minimum value detected by the detection unit is larger than 1, and determines that the second state is formed, in a case where the number of detections of a current minimum value detected by the detection unit is not larger than 1.

9. The image forming apparatus according to claim 1, further comprising a sensor configured to detect a test image formed on the intermediate transfer member, wherein the control unit determines which state of the first state and the second state is formed, based on a detection result of the test image that is obtained by the sensor, and a detection result obtained by the detection unit when the test image can be formed on the intermediate transfer member by transferring toner images onto the intermediate transfer member from the first image bearing member and the second image bearing member, the first image bearing member is charged by the first charging member, and voltage is applied to the first transfer member and the second transfer member from the transfer power source.

10. The image forming apparatus according to claim 1, further comprising a second charging member configured to charge the second image bearing member, wherein the control unit determines which state of the first state and the second state is formed, based on a detection result obtained by the detection unit when the first image bearing member is charged by the first charging member, the second image bearing member is charged by the second charging member, and voltage is applied to the first transfer member and the second transfer member from the transfer power source.

11. The image forming apparatus according to claim 1, wherein the first image bearing member is an image bearing member configured to bear a black toner image.

12. The image forming apparatus according to claim 1, wherein the first transfer member and the second transfer member are conductive brush members.

13. The image forming apparatus according to claim 1, wherein the first transfer member and the second transfer member are roller members having conductivity.

14. An image forming apparatus comprising:

a first image bearing member configured to bear a toner image;

a first charging member configured to charge the first image bearing member;

a second image bearing member configured to bear a toner image with a color different from the first image bearing member;

a second charging member configured to charge the second image bearing member;

an intermediate transfer member onto which a toner image borne by at least one of the first image bearing member or the second image bearing member is transferred;

a first transfer member that is disposed at a position corresponding to the first image bearing member via the intermediate transfer member, and is configured to transfer a toner image onto the intermediate transfer member from the first image bearing member;

a second transfer member that is disposed at a position corresponding to the second image bearing member via the intermediate transfer member, and is configured to transfer a toner image onto the intermediate transfer member from the second image bearing member;

a transfer power source configured to apply voltage to the first transfer member and the second transfer member;

a detection unit configured to detect currents flowing in the first transfer member and the second transfer member, in a case where voltage is applied to the first transfer member and the second transfer member from the transfer power source; and a control unit configured to select and execute either a first mode of transferring a toner image onto the intermediate transfer member from at least one of the first image bearing member or the second image bearing member in a first state in which the first transfer member and the second transfer member are in contact with the intermediate transfer member, or a second mode of transferring a toner image onto the intermediate transfer member from the first image bearing member in a second state in which the first transfer member is in contact with the intermediate transfer member and the second transfer member is separated from the intermediate transfer member, wherein the control unit determines which state of the first state and the second state is formed, based on a first current value and a second current value that are detected by the detection unit in a state in which the first image bearing member and the second image bearing member are respectively charged by the first charging member and the second charging member, and voltage is applied to the first transfer member and the second transfer member from the transfer power source, and wherein the second current value is a current value detected by the detection unit after the first current value is detected, and after a surface potential of the second image bearing member is switched.

15. The image forming apparatus according to claim 14, wherein the control unit switches a surface potential of the second image bearing member by stopping charging of the second image bearing member that is performed by the second charging member.

16. The image forming apparatus according to claim 14, further comprising an exposure unit configured to expose the second image bearing member, wherein the control unit switches a surface potential of the second image bearing member by exposing the second image bearing member from the exposure unit.

17. The image forming apparatus according to claim 14, wherein the detection unit is electrically connected between the transfer power source and a ground, and detects a total value of the current flowing in the first transfer member and the current flowing in the second transfer member, in a case where voltage is applied to the first transfer member and the second transfer member from the transfer power source.

18. The image forming apparatus according to claim 14, wherein the control unit determines that the first state is formed, in a case where the first current value is larger than the second current value, and determines that the second state is formed, in a case where the first current value is smaller than or equal to the second current value.

19. The image forming apparatus according to claim 14, further comprising:

a first development member configured to be in contact with or separated from the first image bearing member, and to develop an electrostatic latent image formed on the first image bearing member using toner, in a state of being in contact with the first image bearing member; and a second development member configured to be in contact with or separated from the second image bearing member, and to develop an electrostatic latent image formed on the second image bearing member using toner, in a state of being in contact with the second image bearing member, wherein the control unit determines which state of the first state and the second state is formed, based on a detection result obtained by the detection unit when the first development member is separated from the first image bearing member, the second development member is separated from the second image bearing member, and voltage is applied to the first transfer member and the second transfer member from the transfer power source.

20. The image forming apparatus according to claim 14, wherein the first image bearing member is an image bearing member configured to bear a black toner image.

21. The image forming apparatus according to claim 14, wherein the first transfer member and the second transfer member are conductive brush members.

22. The image forming apparatus according to claim 14, wherein the first transfer member and the second transfer member are roller members having conductivity.

* * * * *